US006945605B2

(12) United States Patent
Kinoshita et al.

(10) Patent No.: US 6,945,605 B2
(45) Date of Patent: Sep. 20, 2005

(54) CHAIR HAVING A SLIDE MECHANISM FOR THE SEAT

(75) Inventors: Yojiro Kinoshita, Osaka (JP); Nobuyuki Ueda, Osaka (JP); Toshiyuki Horiki, Nagano (JP); Kazuyuki Itoh, Nagano (JP); Hiroyuki Nishimura, Nagano (JP)

(73) Assignees: Kokuyo Co., Ltd., Osaka (JP); Takano Co., Ltd., Nagano (JP)

( * ) Notice: Subject to any disclaimer, the term of this patent is extended or adjusted under 35 U.S.C. 154(b) by 120 days.

(21) Appl. No.: 10/130,750

(22) PCT Filed: Oct. 9, 2001

(86) PCT No.: PCT/JP01/08864

§ 371 (c)(1),
(2), (4) Date: May 23, 2002

(87) PCT Pub. No.: WO02/32262

PCT Pub. Date: Apr. 25, 2002

(65) Prior Publication Data

US 2002/0180248 A1 Dec. 5, 2002

(30) Foreign Application Priority Data

Oct. 16, 2000 (JP) ..... 2000-315756
Oct. 16, 2000 (JP) ..... 2000-315758
Jun. 27, 2001 (JP) ..... 2001-195601

(51) Int. Cl.[7] ..... A47C 1/022; A47C 1/023; A47C 1/024

(52) U.S. Cl. ..... 297/317; 297/332; 297/337

(58) Field of Search ..... 297/317, 322, 297/337, 341, 311, 318, 344.1, 344.13, 300.3, 300.2, 341.17, 362.11, 362.14, 362.12, 362, 284.1; 248/424, 429; 74/89.23, 89.32, 89.45

(56) References Cited

U.S. PATENT DOCUMENTS 3,337,266 A * 8/1967 Burns ..... 297/317
3,572,829 A * 3/1971 Malitte ..... 297/317
3,982,785 A * 9/1976 Ambasz ..... 297/337 X
4,491,366 A * 1/1985 Silber ..... 297/322 X
4,502,729 A * 3/1985 Locher ..... 297/300.3
4,763,950 A * 8/1988 Tobler ..... 297/300.3
5,108,149 A 4/1992 Ambasz
5,150,948 A * 9/1992 Volkle ..... 297/317 X
5,158,074 A * 10/1992 Grellas ..... 601/24
5,199,764 A * 4/1993 Robinson ..... 297/362.11

(Continued)

FOREIGN PATENT DOCUMENTS

DE 3520188 A1 * 12/1985 ..... 297/322
EP 460717 A2 * 12/1991 ..... 297/317
JP 42-4503 B1 2/1967
JP 3-102948 U 10/1991
JP 7-163438 A 6/1995
JP 8-38294 A 2/1996

*Primary Examiner*—Rodney B. White
(74) *Attorney, Agent, or Firm*—Banner & Witcoff Ltd.

(57) ABSTRACT

A chair includes a seat portion 1(1B), a seat support 2(2B) supporting the seat portion 1, a rear seat support 3(3B) extending rearwardly upwardly relative to the seat support 2(2B), and a slide mechanism X1 (moving mechanism XB) for causing the seat portion 1(1B) to slide back and forth relative to the seat support 2 (2B). The chair is provided with a locking mechanism 100C for locking the seat portion 6C at a desired position in the fore-and-aft direction selectively, and a lever 110C for operating the locking mechanism 100C, the lever 110C being located at a position allowing the lever 110C to move together with the seat portion 6C in the fore-and-aft direction.

23 Claims, 25 Drawing Sheets

U.S. PATENT DOCUMENTS 5,261,723 A * 11/1993 Hosoe ..... 297/322 X
5,397,165 A * 3/1995 Grin et al. ..... 297/322 X
5,556,163 A * 9/1996 Rogers et al. ..... 297/330
5,603,551 A * 2/1997 Sheehan ..... 297/329
5,826,940 A * 10/1998 Hodgdon ..... 297/303.1
5,871,258 A * 2/1999 Battey et al. ..... 297/317
5,979,986 A * 11/1999 Pejathaya ..... 297/362.12
6,027,168 A * 2/2000 Crossman et al. ..... 297/337
6,058,798 A * 5/2000 Lantzsch ..... 74/530
6,070,938 A * 6/2000 Elio ..... 297/374
6,086,157 A * 7/2000 Toso ..... 297/423.11
6,132,001 A * 10/2000 Su ..... 297/411.36
6,135,556 A * 10/2000 Chu et al. ..... 297/337
6,244,660 B1 * 6/2001 Yoshimatsu ..... 297/344.1
6,540,296 B1 * 4/2003 Shats et al. ..... 297/353
6,588,844 B1 * 7/2003 Stenzel ..... 297/300.2
6,641,214 B2 * 11/2003 Veneruso ..... 297/322
6,824,219 B2 * 11/2004 Ruckstadter ..... 297/317 X
2003/0025371 A1 * 2/2003 Veneruso ..... 297/322
2003/0173808 A1 * 9/2003 Ruckstadter ..... 297/317 X

* cited by examiner

CHAIR HAVING A SLIDE MECHANISM FOR THE SEAT

CROSS REFERENCE TO RELATED APPLICATIONS

This is a U.S. National Phase Application under 35 U.S.C. § 371 and applicant herewith claims the benefit of priority of PCT/JP01/08864, filed Oct. 9, 2001, which was published Under PCT Article 21(2) in Japanese, which claims priority to Japanese Application Nos. P2000-315756, filed Oct. 16, 2000, P2000-315758, filed Oct. 16, 2000, and P2001-195601, filed Jun. 27, 2001, the entire contents of which are incorporated herein by reference.

TECHNICAL FIELD

The present invention relates to a chair which is capable of adjusting the depth of its seating surface according to the build of a person sitting thereon.

BACKGROUND ART

Generally, if the depth of the seating surface of a chair is too large or too small as compared with the build of a sitter, the sitter is forced to assume an unnatural posture. In this respect, there is conventionally known a chair of the type which includes a seat portion and a backrest portion and which is constructed to be capable of adjusting the depth of the seat portion that can substantially support the back of a sitter according to the build of the sitting person by moving either the seat portion or the backrest portion back and forth substantially horizontally.

Such a chair, however, has an inconvenience that when the backrest portion is moved forward or the seat portion is moved backward, an rear end portion of the seat portion protrudes rearwardly beyond the backrest portion, making the appearance of the chair very bad. A chair of the type which is free of a backrest portion or which is incapable of moving its seat portion or backrest portion back and forth, inherently cannot adjust the depth of the seat portion based on the aforementioned construction and, therefore, a sitter is forced to sit thereon in an uncomfortable posture if the specifications of the chair are not suited to the build of the sitter. To avoid such an inconvenience, a chair suited to the build of an individual sitter must be obtained (first problem).

Also, there is conventionally known a chair of the type constructed to allow its seat portion to move back and forth with a rear end portion thereof gradually rising so that the depth of the seating surface can be adjusted according to the build or posture of a sitter. In the seat portion of such a chair, usually the reverse side of a seat body having a cushioning property is substantially entirely covered with a relatively rigid shell formed from a resin or the like.

Such a construction, however, gives rise to an inconvenience that the rear end portion of the seat body gradually rising rearwardly does not curve smoothly due to the seat body covered with the rigid shell that does not bend so much and, hence, wrinkles of projection and depression shape are formed on an upper surface of the seat body at the boundary between a substantially horizontal front end side and a gradually rising rear end side, with the result that the seat body, which essentially must be soft to a certain degree, becomes hard at the wrinkled portion, thus imparting a sense of incongruity to the sitter at his or her buttocks, hence making the chair uncomfortable to sit.

With a view to eliminating such an inconvenience, a chair has been devised such that the reverse side of a seat body including its rear end portion adapted to rise gradually is substantially entirely covered with a flexible shell to avoid the formation of hard wrinkles of projection and depression shape on the seat body. Such a chair, however, is not necessarily comfortable to sit because the shell deforms flexibly along a seat support even at a portion supporting the thighs of the sitter and, hence, the sitter feels the hardness of the seat support constructed of a metal frame or the like at his or her thighs through the shell and cushion (second problem).

Practical use has recently been made of chairs provided with various mechanisms including a backrest inclining mechanism, a rocking mechanism, a fore-and-aft seat position adjusting mechanism, and like mechanism for sitters to assume a proper posture at work, a resting posture or a refreshing posture selectively.

When attention is paid to the fore-and-aft seat position adjusting mechanism among such mechanisms, a conventional one is constructed to allow the seat portion to move back and forth relative to the seat support and to be locked at a desired position and, hence, a manipulating section for operating this mechanism is usually located on the seat support side along with manipulating sections for operating the rocking mechanism and the like.

However, the fore-and-aft movement of the seat portion causes the position of the manipulating section relative to the seat portion to change. This may result in an inconvenience that when the sitter wants to operate the fore-and-aft seat position adjusting mechanism while keeping his or her sitting posture, the sitter has a difficulty in catching the manipulating section properly with his or her fingers if the sitter puts his or her hand on the seat portion, or the sitter is likely to lose his or her balance due to the support for the sitter's body becoming unstable if the sitter puts his or her hand on the manipulating section. A chair of the type constructed to move the seat portion back and forth with the help of manipulating power of a human putting his or her hand on the seat portion, in particular, requires firm grasping of the seat by the sitter, so that the sitter has a difficulty in catching the manipulating section with his or her fingers and hence is forced to perform a more difficult manipulation (third problem).

DISCLOSURE OF INVENTION

With a view to solving the first problem, the present invention intends to provide a chair which is capable of varying the depth of a seating surface according to the build of a sitter regardless of whether the chair is provided with a backrest portion or not.

That is, a chair according to the present invention comprises a seat portion, a seat support supporting the seat portion, a rear seat support extending rearwardly upwardly relative to the seat support on a rear end side of the seat portion, a slide mechanism including members disposed in association with the seat portion and the seat support and meshing with each other to cause the seat portion to slide back and forth relative to the seat support in a manner to cause a rear end portion of the seat portion to rise gradually along the rear seat support, and a restraining section for releasably restraining the sliding movement of the seat portion caused by the slide mechanism.

With this construction, the depth of the seat portion, that is, the fore-and-aft dimension of a region that is capable of substantially supporting a body part extending from the buttocks to the thighs of a sitter, can be adjusted according to the builds of individual sitters by sliding the seat portion back and forth through the simplified slide mechanism. Further, when the restraining section restrains the seat portion from sliding, the stability of the seat portion on which the sitter is sitting is improved, while when the restraint is released as required, it becomes possible to adjust the depth of the seating face. Furthermore, since the rear end portion of the seat portion rises gradually along the rear seat support as the seat portion is moved backward to shorten the depth of the seat portion, it is possible to effectively avoid the inconvenience that only the rear end portion of the seat portion protrudes rearwardly to make the appearance of the chair bad.

Examples of preferred slide mechanisms performing such an operation include one comprising a rack gear and a pinion gear disposed in association with the seat portion and the seat support and meshing with each other.

A preferred one of specific chair constructions is such that the rack gear is secured to the seat support with a longitudinal direction of the rack gear being in line with a fore-and-aft direction, while the pinion gear is supported by the seat portion so as to be capable of rotating forwardly and backwardly.

In such a chair, the seat portion is desirably fitted with a manipulating section for selectively switching the restraining section into a condition allowing the seat portion to move or into a condition restraining the seat portion so that the operation of restraining the sliding movement of the seat portion or releasing the restraint can be constantly performed at a substantially fixed position relative to the seat portion.

For easy rotation of the pinion gear relative to the rack gear and easy sliding movement of the seat portion accompanying the same with a simplified arrangement, it is preferred that the restraining section be provided with a stopper gear that is capable of disengageably meshing with the pinion gear to restrain the pinion gear from rotating through an operation of the manipulating section. Particularly where a feature is desired such that the stopper gear is capable of constantly meshing with the pinion gear to restrain the pinion gear from rotating when fore-and-aft movement of the seat portion is not necessary, while the meshing of the stopper gear with the pinion gear can be released only when the seat portion is to be moved, such an arrangement is effective wherein: the restraining section is provided with an elastic member elastically deformably pressing the stopper gear in a direction such as to allow the stopper gear to mesh with the pinion gear; and the restraint of rotation of the pinion gear is released when the manipulating section is manipulated against the elastic force of the elastic member.

Another preferred one of specific chair constructions is such that the rack gear is secured to the seat portion with a longitudinal direction of the rack gear being in line with a fore-and-aft direction, while the pinion gear is supported by the seat support so as to be capable of rotating forwardly and backwardly.

In such a chair, the seat support is preferably fitted with a manipulating section for selectively switching the restraining section into a condition allowing the seat portion to move or into a condition restraining the seat portion so that the operation of restraining the sliding movement of the seat portion or releasing the restraint can be performed at a predetermined position that does not move back and forth together with the seat portion.

In this case, for easy rotation of the pinion gear relative to the rack gear and easy sliding movement of the seat portion accompanying the same with a simplified arrangement, it is effective that the restraining section comprises a dent portion formed at the seat support, and a stopper pin capable of retractably fitting into the dent portion to restrain the pinion gear from rotating through an operation of the manipulating section.

If a feature is desired such that the stopper pin is constantly fitted into the dent portion to restrain the pinion gear from rotating when fore-and-aft movement of the seat portion is not necessary, while the fitting of the stopper pin into the dent portion can be released only when the seat portion is to be moved, such an arrangement is effective wherein: the restraining section is provided with an elastic member elastically deformably pressing the stopper pin in a direction such as to allow the stopper pin to become fitted into the dent portion; and the restraint of rotation of the pinion gear is released when the manipulating section is manipulated against the elastic force of the elastic member.

In any one of the chair constructions described above, it is desirable that a movable range restricting section for restricting the sliding movement of the seat portion within a predetermined range be formed in association with the seat portion and the seat support to predetermine an expected suitable range within which sliding movement of the seat portion is possible, thereby preventing the seat portion from coming off the seat support during the sliding movement of the seat portion.

In view of the second problem, the present invention provides a chair which offers satisfactory sitting comfort at any part of a seat portion.

That is, a chair according to the present invention comprises a seat portion having a seat body with a cushioning property, a seat support supporting at least a front end side of the seat portion, a rear seat support extending rearwardly upwardly relative to the seat support on a rear end side of the seat support, and a moving mechanism for moving the seat portion back and forth in a manner to gradually raise a rear end side of the seat portion rearwardly along the rear seat support, the seat body having a reverse side held by a rigid seat plate mounted to cover at least an extent from a front end side to a central portion of the reverse side and a flexibly deformable rear seat plate mounted at a rear end side of the reverse side, the rear seat plate being capable of smoothly curving to allow a rear end portion of the seat body to gradually rise along the rear seat support through the rear seat plate. The seat support and the rear seat support may be either separate members adapted to support corresponding parts of the seat body or an integral member adapted to support the seat body.

In the chair thus constructed, the rear seat plate adapted to gradually rise along the rear seat support at a rear end portion of the seat portion becomes smoothly curved according to the angle of inclination of the rear seat support and, hence, the rear end portion of the seat body supported on the rear seat plate, also, becomes smoothly curved to rise gradually while following the rear seat plate. As a result, the rear end portion of the seat body is free from the formation of wrinkles of projection and depression shape, hence, prevented from becoming hard. Thus, a sitter on the chair is not given a sense of incongruity at his or her buttocks. Further, since the rigid seat plate is mounted to cover the extent from the front end portion to the central portion of the reverse side of the seat body or, as the case may be, an extent up to a location just short of reaching the rear seat plate, the sitter does not feel the hardness of the seat support at his or her thighs through the seat body and, hence, any part of the seat body offers a good sitting comfort. Furthermore, since this chair is capable of varying the depth of a seating surface of the seat body that can effectively support a body part from the buttocks to the thighs of the sitter according to the build of the sitter by moving the seat portion back and forth through the moving mechanism, the chair offers a good sitting comfort however adjusted the fore-and-aft position of the seat portion may be.

Particularly, for easily realizing smooth curving of the rear seat plate, it is desirable that the rear seat plate be formed with a plurality of groove portions arranged parallel in the fore-and-aft direction and each extending in a direction substantially perpendicularly intersecting the moving direction of the seat portion.

It is effective in easy formation of such grooves that the rear seat plate is carved so as to dent partially thereby forming the grooves.

In preventing the sitting comfort from becoming bad due to the seat portion lifting off the seat support or the rear seat support during the fore-and-aft movement of the seat portion, it is desirable that a lift-off inhibiting section be formed in association with the rear seat plate, the seat support and the rear seat support for inhibiting the rear seat plate to lift off the seat support and the rear seat support.

A simple and effective arrangement for such a liftoff inhibiting section comprises a slot defined at the rear seat plate to extend in the fore-and-aft direction, and pins attached to the seat support and the rear seat support, respectively, each of the pins having a head portion sized larger than the width of opening of the slot and a shank portion inserted through the slot.

The present invention further provides the following means for resolving the third problem.

That is, a chair according to the present invention comprises a seat portion mounted on a seat support so as to be capable of moving in a fore-and-aft direction, the chair being provided with a locking mechanism for selectively locking the seat portion at a desired position in the fore-and-aft direction, and a manipulating section for operating the locking mechanism, the manipulating section being located at a position allowing the manipulating section to move together with the seat portion in the fore-and-aft direction.

In such a chair, the manipulating section moves together with the seat portion whenever the seat portion moves back and forth and, hence, the position of the manipulating section relative to the seat portion will not change. For this reason, the chair allows a sitter to assuredly assume a manipulating posture with his or her hand put on the seat portion and with his or her fingers properly catching the manipulating section, thus making good operability and sitting posture stability compatible with each other advantageously.

A specific embodiment of this construction is such that the seat portion is supported on the seat support through a rack-and-pinion mechanism comprising a rack located on a seat support side and a pinion located on a seat portion side together with the locking mechanism and the manipulating section.

An example of a simple locking mechanism for use in this case comprises a stopper piece for locking the pinion by selectively meshing with the same through movement toward and away from the pinion.

It is desirable that the stopper piece be configured to move horizontally toward and away from the pinion so that the space between the seat support and the seat portion can be prevented from becoming bulky due to the provision of the locking mechanism.

The present invention thus constructed is particularly useful when applied to a chair of the type wherein the fore-and-aft movement of the seat portion is caused by a manipulating force applied from outside.

In making the manipulating section easy to use and have a good appearance in view of its balance with manipulating sections of other mechanisms, it is effective that the manipulating section for operating the locking mechanism and the manipulating sections located on a seat support side for operating other mechanisms are arranged with apparent regularity at predetermined locations in at least the fore-and-aft direction.

A preferred one of specific embodiments of such a manipulating section is lever-shaped and assumes a substantially horizontal posture when it is not manipulated.

BEST MODE FOR CARRYING OUT THE INVENTION

Hereinafter, the present invention will be described in detail by way of embodiments shown in the attached drawings.

First Embodiment

Figure 1:
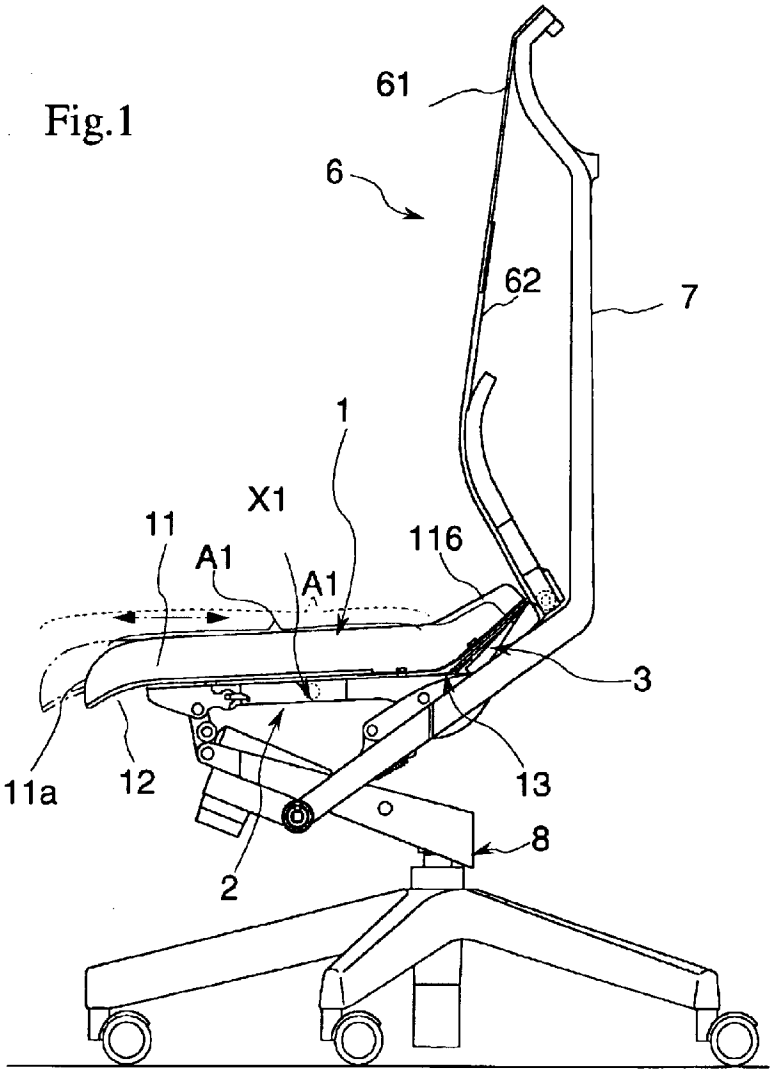
FIG. 1 is a side elevational view showing a chair according to a first embodiment of the present invention.
Figure 2:
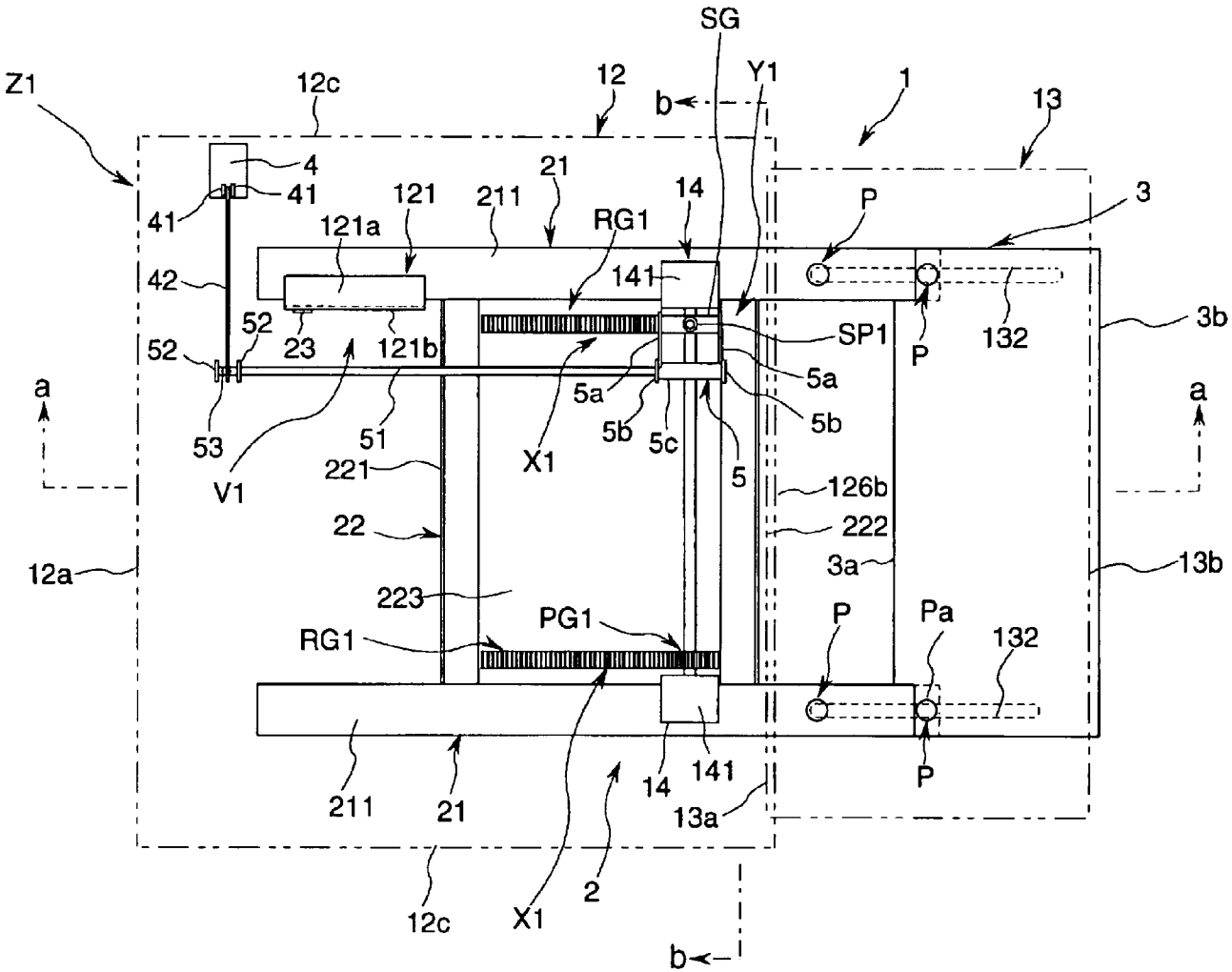
FIG. 2 is a partially cutaway plan view showing a seat portion in the same embodiment.
Figure 3:
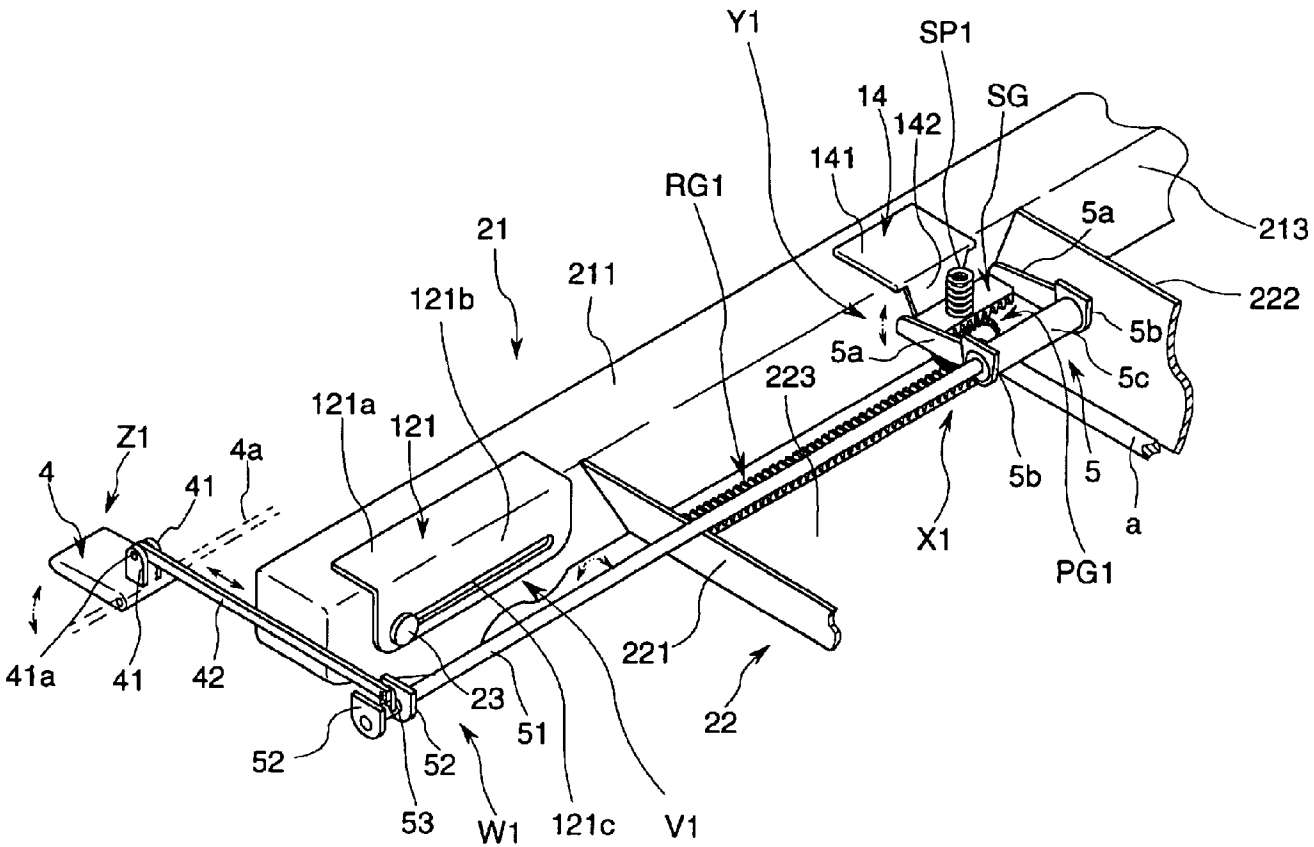
FIG. 3 is a perspective view showing a relevant part in the same embodiment.
Figure 4:
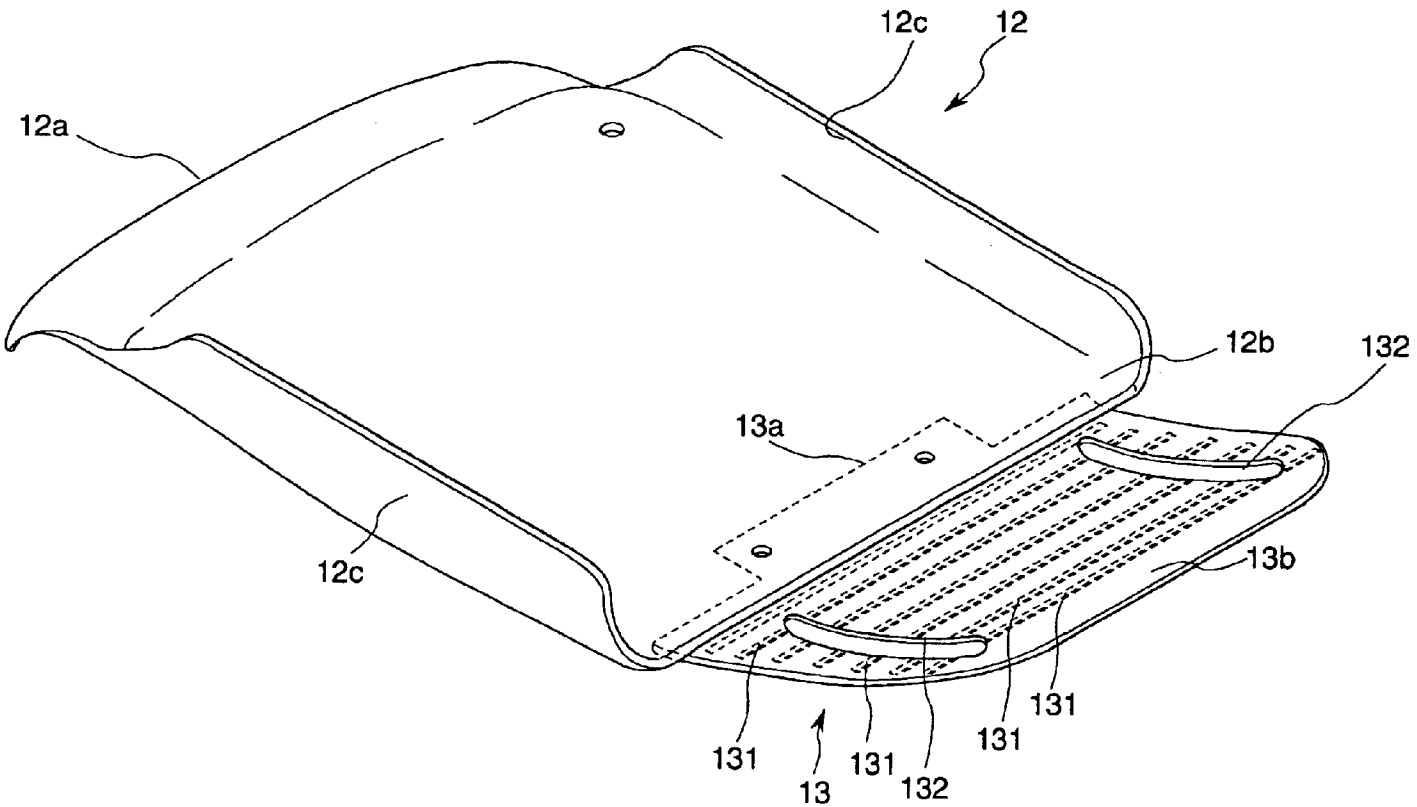
FIG. 4 is a perspective view showing a seat plate and a rear seat plate in the same embodiment.
Figure 5:
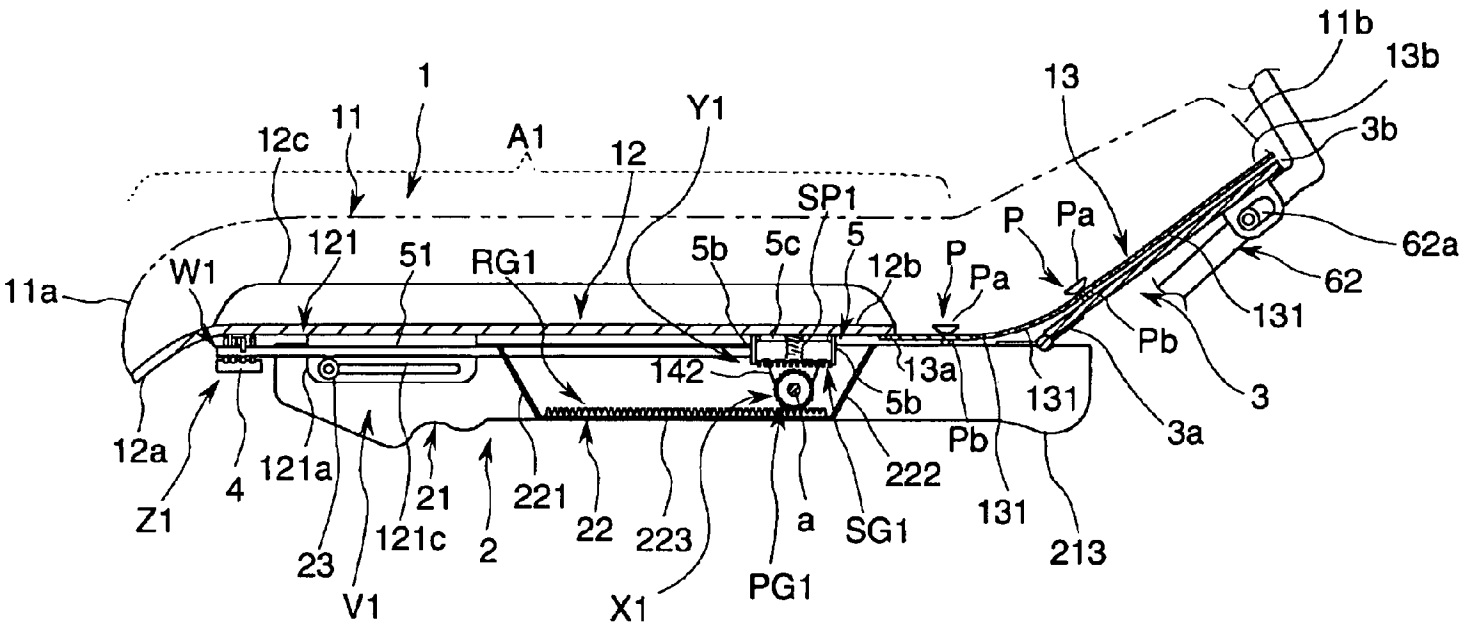
FIG. 5 is a sectional view taken on line a—a in FIG. 2.
Figure 6:
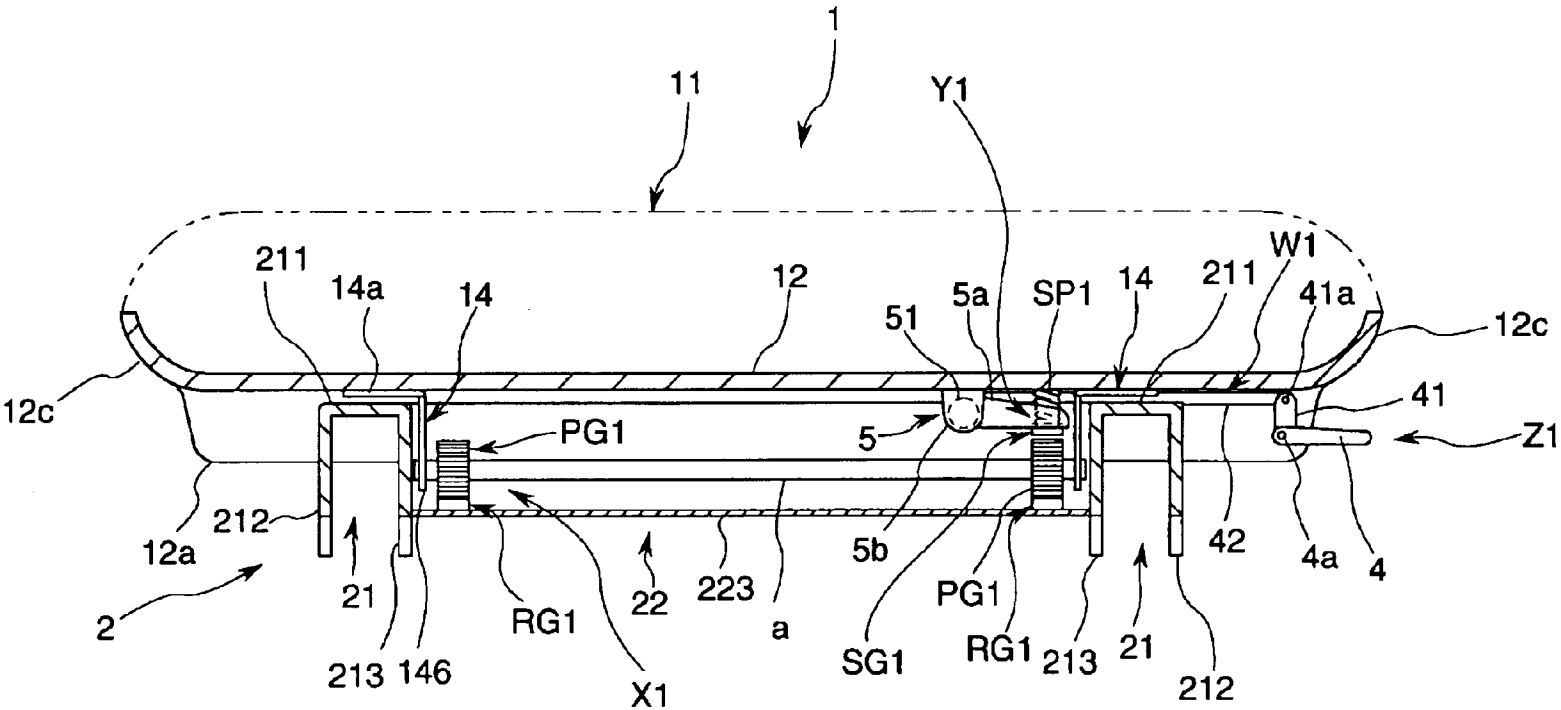
FIG. 6 is a sectional view taken on line b—b in FIG. 2.
Figure 7:
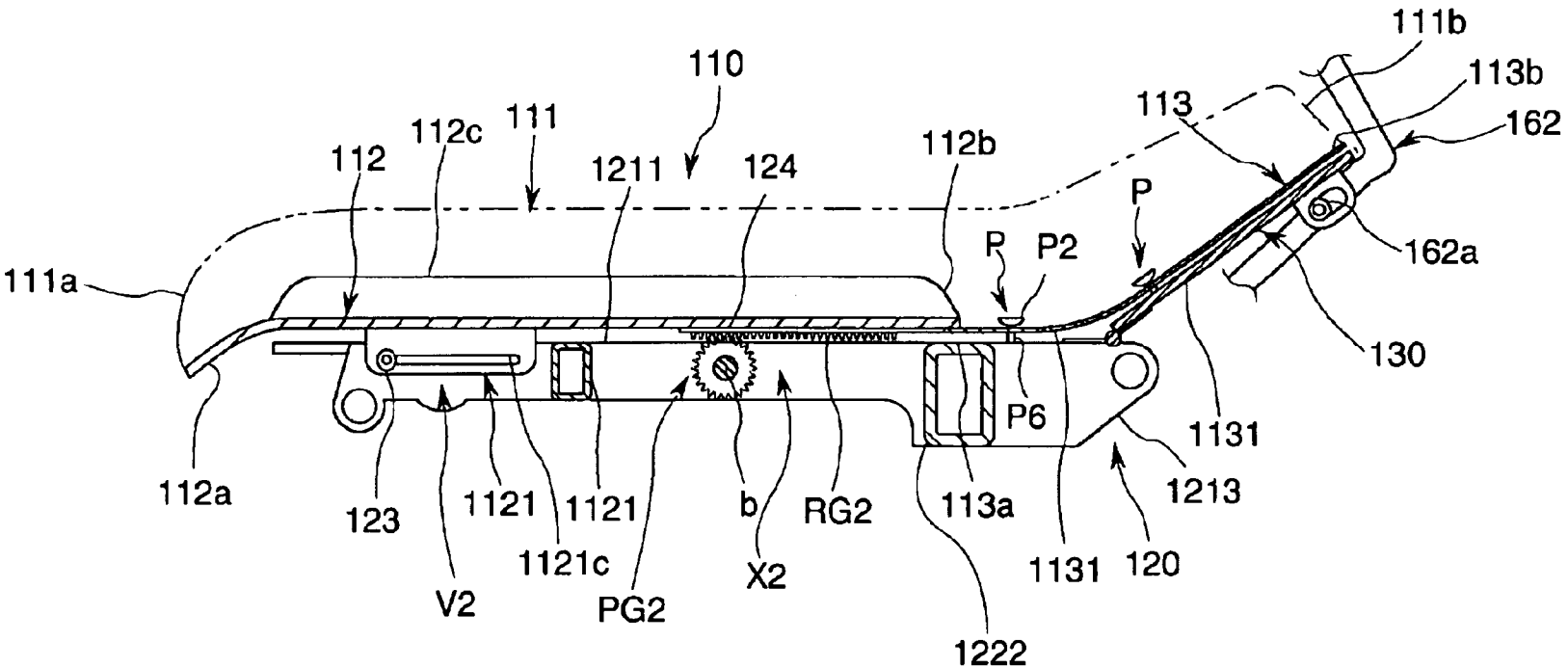
FIG. 7 is a sectional view, corresponding to FIG. 5, showing a seat portion in a second embodiment of the present invention.
Figure 8:
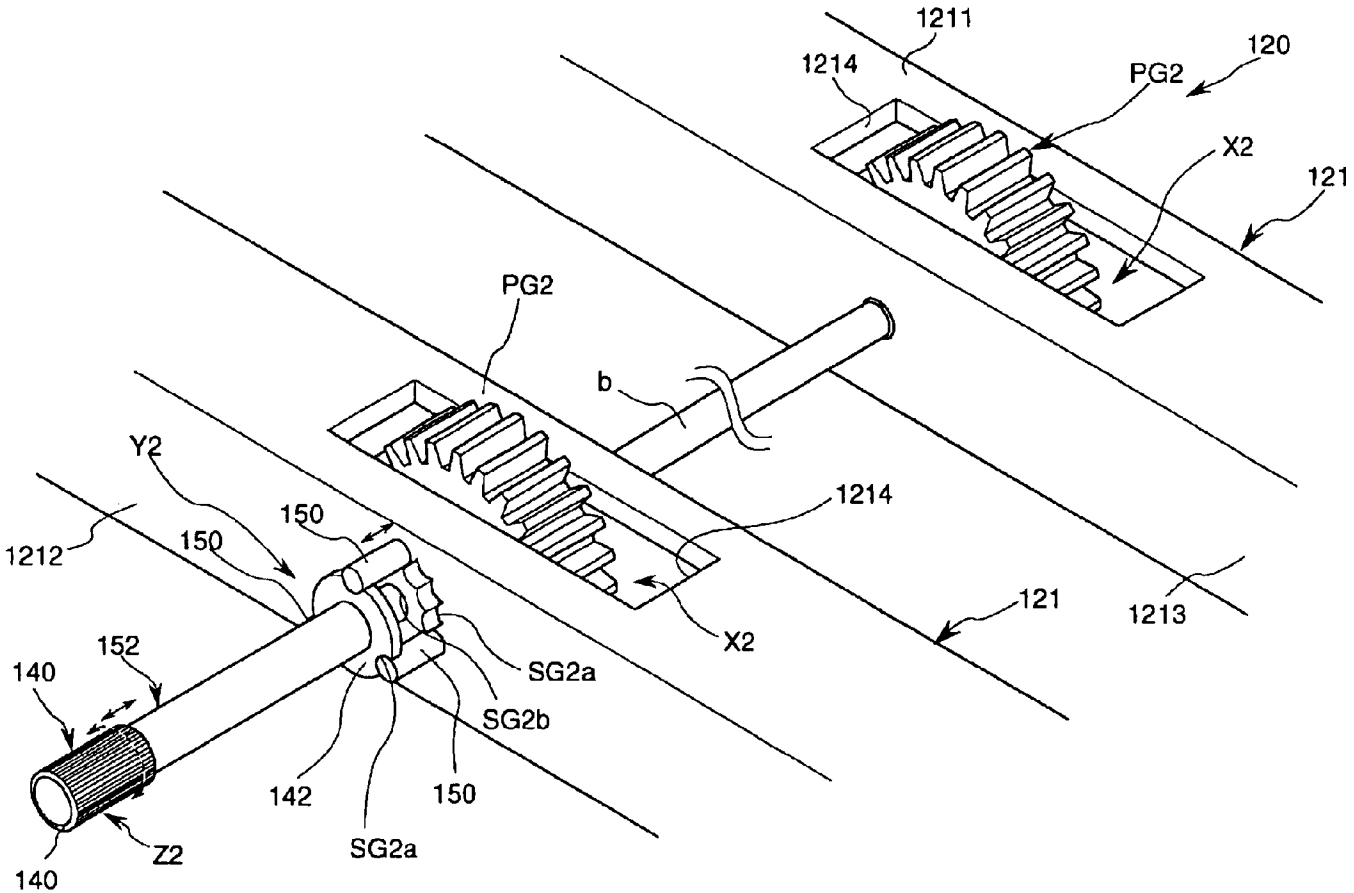
FIG. 8 is a perspective view showing a relevant part in the same embodiment.
Figure 9:
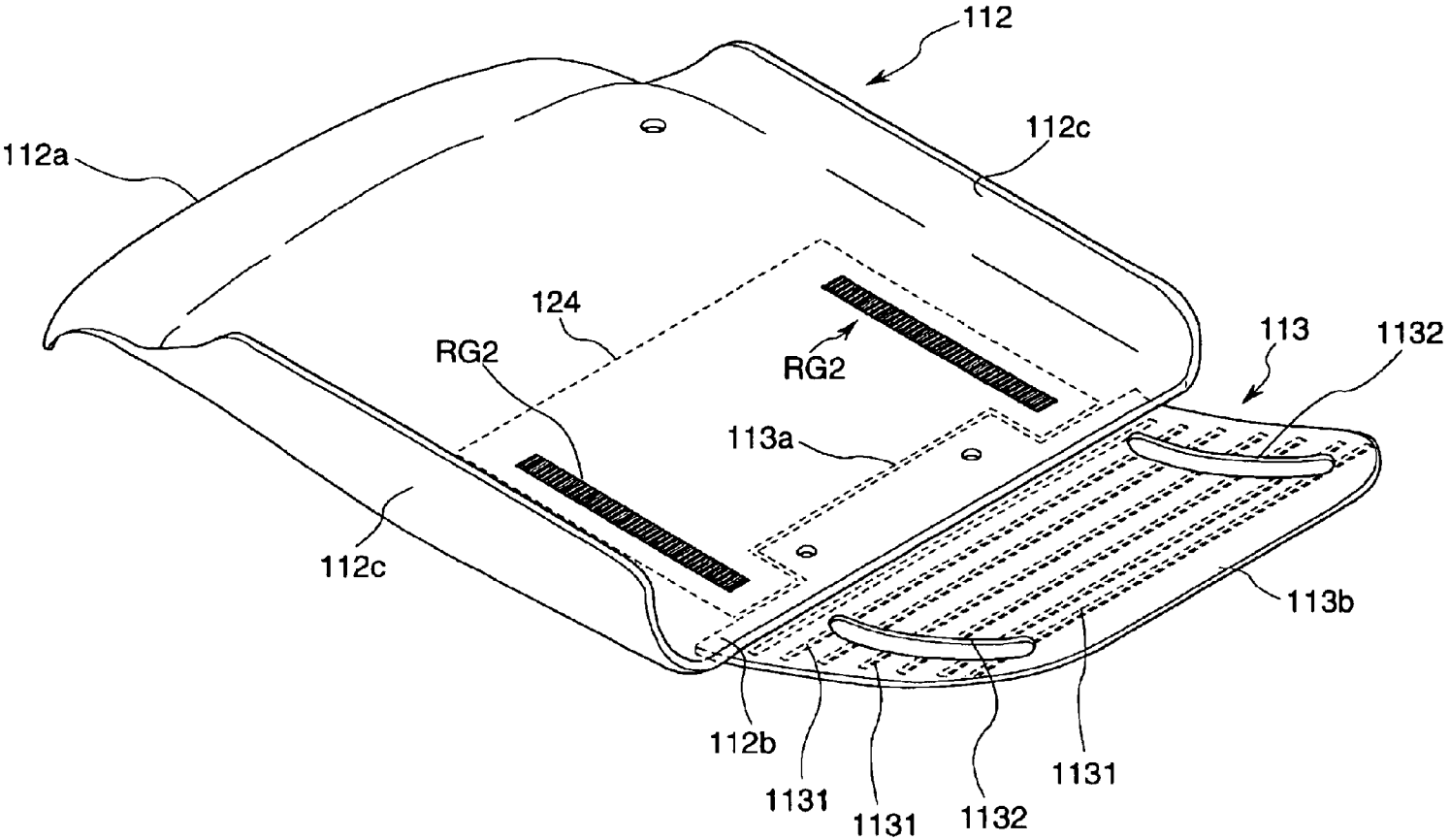
FIG. 9 is a perspective view showing a seat plate and a rear seat plate in the same embodiment.
Figure 10:
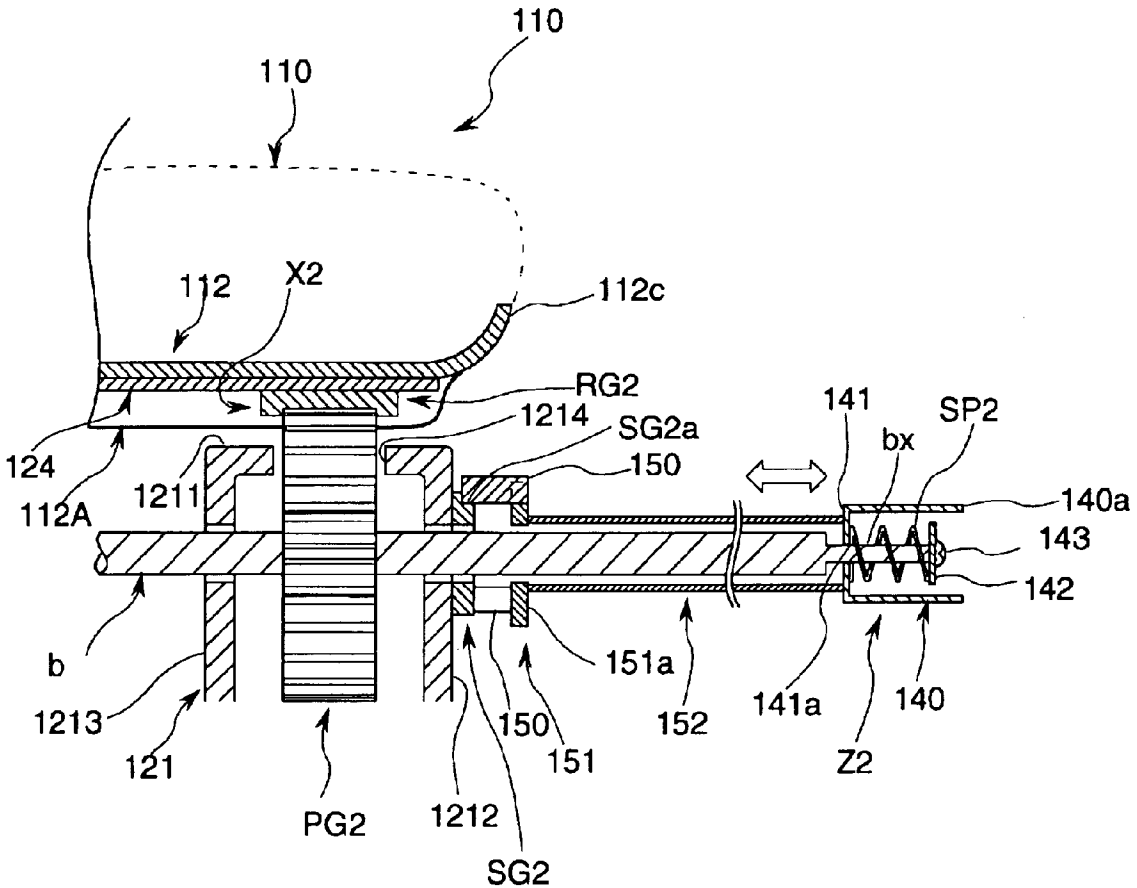
FIG. 10 is an enlarged sectional view showing a relevant part in the same embodiment.

As shown in FIG. 1, a chair according to this embodiment includes a seat portion 1, a backrest portion 6, a seat support 2 supporting the seat portion 1, a back support pillar 7 supporting the backrest portion 6, and a leg portion 8 contacting a floor surface and supporting the seat support 2 and the back support pillar 7. In association with the seat portion 1 and the seat support 2 there is provided a slide mechanism X1 for causing the seat portion 1 to slide in the fore-and-aft direction.

As shown in FIGS. 1 to 3, 5 and 6, the seat support 2 includes a pair of right and left seat frames 21 each having a front end portion supported by the leg portion 8 and a rear end portion supported by the back support pillar 8, the seat frames 21 extending substantially horizontally in the fore-and-aft direction, and a coupling member 22 interconnecting the two seat frames 21. The seat frames 21 are each a channel bar having a top wall 211, an outer wall 212 and an inner wall 213 and U-shaped in section with an opening oriented downward. The coupling member 22 is shaped like a vessel having a front wall 221, a rear wall 222 and a bottom wall 223, and outwardly oriented faces of these walls are joined with the inner walls 213 of the seat frames 21 by welding or the like to reinforce the seat frames 21. Between the rear end portions of the seat frames 21 is fitted a lower end portion 3*a* of the plate-shaped rear seat support 3 extending rearwardly upwardly with an inclination. The rear seat support 3 has an upper end portion 3*b* supported on a bent portion of a substantially V-bent lumbar support 62 by means of a pin 62*a*, the lumbar support 62 being mounted on an upper end portion of the leg portion 8 so as to be rotatable forwardly and backwardly. For support, the upper end portion 3*b* of the rear seat support 3 is fitted with a bracket 31 having a hole portion 311 in which the pin 62*a* is movably supported. The lumbar support 62 serves to support the waist of a sitter and is fitted with a lower end portion of a flexible upholstery member 61 attached to a portion of the back support pillar 7.

On the other hand, as shown in FIGS. 1 to 6, the seat portion 1 includes a seat body 11 having a cushioning property, a rigid seat plate 12 fitted to the reverse side of the seat body 11 so as to support a portion of the seat body 11 from a front end portion 11*a* to a location slightly rearward of a central portion, and a rear seat plate 13 fitted to the seat plate 12 from below so as to support a rear end portion 11*b* of the seat body 11. A region on the upper side of the seat body 11 which can substantially support a body part from the buttocks to the thighs of the sitter is determined as a seating surface A1. The seat body 11 is covered with a cover material not shown.

The seat plate 12 is plate-shaped having side end portions 12*c* curved upward to hold not only the reverse side but also side portions of the seat body 11 and a front end portion 12*a* gently curved downward to align with the legs of the sitter. A bracket 121, L-shaped in front view, has a top wall 121*a* attached to a portion on the reverse side of the front end portion 12*a* of the seat plate 12 along one side end portion 12*a* by screwing from below and a side wall 121*b* defining a slot 121*c* extending therethrough in the thicknesswise direction and elongated in the fore-and-aft direction. Through the slot 121*c* is inserted a pin 23 attached to the inner wall 213 of the corresponding seat frame 21 to allow the seat portion 1 to slide relative to the seat support 2 within a range allowing the slot 121*c* to move back and forth along the pin 23 together with the seat plate 12. This means that the pin 23 and the slot 121*c* form a movable range restricting section V1 defining the sliding movement range of the seat portion 1. Though the embodiment shown has the only one movable range restricting section V1 formed between the seat plate 12 and one seat frame 21, such movable range restricting sections V1 may be formed between the seat plate 12 and the two seat frames 21.

The rear seat plate 13, formed of a flexibly deformable thin resin plate, has a front end portion 13*a* rotatably mounted on a rear end portion 12*b* of the seat plate 12 through a hinge 32 and supports the entire rear end portion 11*b* side of the seat body 11 from below. The rear seat plate 13 has a reverse side formed with a plurality of grooves 131 arranged at a predetermined interval in the fore-and-aft direction, each of the grooves 131 extending widthwise, that is, in a direction perpendicularly intersecting the sliding direction of the seat portion 1. The rear seat plate 13 is further formed with a pair of slots 132 extending through the thickness of the rear seat plate 13, each of the slots 132 being elongated across the plurality of grooves 131 in the fore-and-aft direction. These slots 132 are formed so as to be located just above respective seat frames 21. In mounting the seat portion 1 on the seat support 2 and rear seat support 3, the rear end portion of the seat frames 21 and the lower end portion 3*a* of the rear seat support 3, respectively, are fitted with pins P so that they extend through the slots 132 from above, each of the pins P having a shank portion Pb along which the corresponding slot 132 slides back and forth following the sliding movement of the seat portion 1 and a head portion Pa acting to depress the rear seat plate 13 thereby preventing the rear seat plate 13 from lifting off during the sliding movement of the slots 132.

As shown in FIGS. 2, 3, 5 and 6, the slide mechanism X1 for causing the seat portion 1 to slide back and forth comprises a pair of rack gears RG1 mounted on the seat support 2, and a pair of pinion gears PG1 mounted on the seat portion 1 so as to mesh with respective rack gears RG1. The rack gears RG1 are each shaped into an elongate plate with a plurality of teeth arranged parallel on the upwardly oriented face thereof and are secured to side end portions on an upper side of the bottom wall 223 of the coupling member 22. The pinion gears PG1 are each disk-shaped having a peripheral wall formed with teeth with a pitch equal to that of the rack gears RG1 and are each rotatably mounted on a side wall 142 of a bracket 14 that is L-shaped in front view through a horizontal support shaft a. The bracket 14 has a top wall 141 screwed to the seat plate 12 from below. The right and left pinion gears PG1 share the horizontal support shaft a to operate synchronously with each other.

The seat portion 1 is provided with a restraining section Y1 for releasably restraining the sliding movement of the seat portion 1 caused by the slide mechanism X1, a manipulating section Z1 for operating the restraining section Y1 to switch the seat portion 1 between a slidable condition and a locked condition, and an operation converting section W1 for converting the operation of the manipulating section Z1 into the operation of the restraining section Y1.

The restraining section Y1 is provided with a stopper gear SG1 having a downwardly oriented face formed with a plurality of teeth arranged parallel in the fore-and-aft direction with a pitch equal to that of the pinion gears PG1, and a spring SP1 serving as an elastic member having an upper end portion fixed to the reverse side of the seat plate 12 and a lower end portion fixed to the upper side of the stopper gear SG1 so as to press the stopper gear SG1 in such a direction as to bring the stopper gear SG1 into mesh with the corresponding pinion gear PG1. The manipulating section Z1, on the other hand, comprises a plate-shaped manipulating lever 4 having a substantially rectangular configuration in plan view and located forwardly of one seat frame 21 and below the side end portion 12*c* of the seat plate 12. The manipulating lever 4 has a base end portion defining a through-hole extending therethrough in the fore-and-aft direction and is supported for upward and downward rotation by a shaft 4*a* inserted through the through-hole and attached to the seat plate 12 by appropriate means not shown. A pair of upright pieces 41 are secured to an upwardly oriented face of the base end portion of the manipulating lever 4 by welding or the like. Between the upright pieces 41 is supported an inwardly extending plate-shaped horizontal bar 42 by means of a shaft 41*a* extending through upper end portions of the upright pieces 41 so as to be rotatable and slidable to the right and left. Opposite side end portions of the stopper gear SG1 are supported by a fitting member 5 secured to the reverse side of the seat plate 12. The fitting member 5 comprises a pair of arms 5*a* secured to the opposite side end portions of the stopper gear SG1, a pair of dangling pieces 5*b* secured to the seat plate 12 from below, and a columnar coupling rod 5*c* rotatably supported between the dangling pieces 5*b* and fixing the inner ends of the arms 5*a*. Further, a shaft of rotation 51 extending in the fore-and-aft direction has a rear end portion inserted through one dangling piece 5*b* on the fore side of the fitting member 5 and is secured to the coupling rod 5*c*. The shaft of rotation 51 has a front end portion located substantially immediately below the inner end of the horizontal bar 42 and rotatably supported at this location by a pair of fitting pieces 52 attached to the reverse side of the seat plate 12. To the front end portion of the shaft of rotation 51 is fixed a lower end portion of an upright bar 53 disposed upright between the pair of fitting pieces 52, an upper end portion of the upright bar 53 being rotatably fitted to the inner end of the horizontal bar 42. That is, the aforementioned operation converting section W1 is formed of an arrangement extending from the upright pieces 41 mounted on the manipulating lever 4 through the horizontal bar 42, upright bar 53 and shaft of rotation 51 up to the fitting member 5 supporting the stopper gear SG1.

With such an arrangement, when the manipulating lever 4 is rotated downwardly about the shaft, the horizontal bar 42 rotates downwardly while sliding outwardly, with the upright bar 53 rotating to cause the shaft of rotation 51 to rotate toward the manipulating lever 4 side. As the shaft of rotation 51 rotates, the fitting member 5 rotates in such a direction as to bring the stopper gear SG1 into mesh with the pinion gear PG1, with the result that the pinion gear PG1 assumes a state meshing with both the stopper gear SG1 and the rack gear RG1 and hence becomes restrained from rotating. Since the stopper gear SG1 is depressed downwardly by the elastic force of the spring SP1 at this time, the intermeshing state between the stopper gear SG1 and the pinion gear PG1 will not be released easily. That is, this condition restrains the seat portion 1 from sliding in the fore-and-aft direction. On the other hand, when the manipulating lever 4 is rotated upwardly against the elastic force of the spring SP1, the horizontal bar 42, upright bar 53, shaft of rotation 51 and fitting member 5 operate inversely of the aforementioned operation, so that the stopper gear SG1 moves upward to a position that does not allow the stopper gear SG1 to mesh with the pinion gear PG1. In this condition, the pinion gear PG1 meshing with the rack gear RG1 is capable of freely rotating in the fore-and-aft direction along the rack gear RG1. This means that when the restraint of rotation of the pinion gear PG1 by the stopper gear SG1 is released, it is possible to cause the seat portion 1 to slide back and forth. The movable range of the seat portion 1 in this condition is restricted within the fore-and-aft dimension of the slot 121*c* of the bracket by the movable range restricting section V1. As the seat portion 1 slides, the rear seat plate 13 also slides back and forth while bending along the rear seat support 3. At this time, the rear seat plate 13 is prevented from lifting off the seat frames 21 and the rear seat support 3 because the rear seat plate 13 is depressed from above by the head portions Pa of the pins P. Further, the position at which the rear seat plate 13 becomes curved by bending varies in the fore-and-aft direction depending upon the position to which the seat portion 1 slides. However, the degree of opening of the grooves 131 formed at the reverse side of the rear seat plate 13 varies appropriately depending upon the position to which the seat portion 1 slides thereby realizing proper bending of the rear seat plate 13, so that the rear end portion 11*b* of the seat body 11 is held properly. Thus, when the sitter rotates the manipulating lever 4 downwardly with the seat portion 1 having been slid to a position at which the depth of the seating surface A of the seat body 11 is adjusted to the build of the sitter, the seat portion 1 can be locked at the position. Though the position to which the seat portion 1 slides can be adjusted by weight-shifting of the sitter who is manipulating the manipulating lever 4 while sitting on the seat portion 1, the adjustment can also be made if the sitter raises his or her buttocks from the seat portion 1 or gets off the chair to manipulate the manipulating lever 4 and moves the seat portion 1 back and forth with his or her hand holding a part of the seat portion 1.

Further, the chair according to this embodiment is capable of varying the angle of inclination with which the rear end portion of the seat portion 1 rises rearward regardless of the fore-and-aft position of the seat portion 1 if the lumbar support 62 is rotated in the fore-and-aft direction about its lower end portion supported on the leg portion 8. Specifically, when the lumbar support 62 is rotated forwardly, the lumbar support 62 presses the rear seat support 3 forwardly upwardly, while pin 162*a* moves within the hole portion 311. As a result, the rear seat support 3 inclines more forwardly upwardly about the hinge 32 and, with this movement, the rear seat plate 13 and the rear end portion 11*b* of the seat body 11 incline forwardly with their degree of curving increasing. In this case also, the grooves 131 of the rear seat plate 13 expand or contract according to the degree of curving and, hence, the seat body 11 gradually rises rearward with its smoothness maintained even if the angle of inclination becomes high.

Thus, the chair according to this embodiment is capable of causing the seat portion 1 to slide back and forth by means of the slide mechanism X1 constructed to cause the pinion gears PG1 located at the seat portion 1 to rotate back and forth along the rack gears RG1 located at the seat support 2 and, hence, the sitter is capable of adjusting the depth of the seating surface A1 according to his or her own build so as to sit on the chair with a proper posture. Further, since it is possible to releasably restrain the sliding movement of the seat portion 1 at the position adjusted by the sitter by means of the restraining section Y1 formed in association with the seat portion 1 and the seat support 2, the seat portion 1 will not move unexpectedly when the sitter is sitting thereon. Furthermore, since the rear end portion of the seat portion 1 moves so as to gradually rise along the rear seat support 3 extending as inclining rearwardly upwardly relative to the seat support 2, the rear end portion of the seat portion 1 does not protrude rearward ill-fittingly, so that the appearance of the chair is maintained favorable.

Moreover, since it is possible to selectively switch the seat portion 1 between the movable condition and the restrained condition by means of the restraining section Y1 through an operation of the manipulating section Z1 located at the seat portion 1 so as to be slidable with the sliding movement of the seat portion 1, the manipulating section Z1 constantly assumes a fixed position relative to the seat portion 1 and, hence, it is very convenient for the sitter as sitting on the chair to adjust the depth of the seating surface A1 by manipulating the manipulating section Z1.

Specifically, the restraining section Y1 includes the stopper gear SG1 that is movable up and down through manipulation of the manipulating section Z1 and is arranged to restrain the rotation of the pinion gears PG1 when the stopper gear SG1 moves downward to mesh with the corresponding pinion gear PG1. With such a simple arrangement, it is possible to restrain the pinion gears PG1 from rotating or release the restraint, hence, restrain the sliding movement of the seat portion 1 with rotation of the pinion gears PG1 or release the restraint of the sliding movement easily. Particularly, the restraining section Y1 of such an arrangement is constructed such that: the spring SP1 is provided as the elastic member that presses the stopper gear SG1 in such a direction as to bring the stopper gear SG1 into mesh with the pinion gear PG1; and the restraint of rotation of the pinion gears PG1 is released by manipulating the manipulating section Z1 against the elastic force of the spring SP1. Thus, the seat portion 1 usually assumes its unslidable condition by the elastic force of the spring SP1, whereby the stability of the seat portion 1 on which the sitter is sitting can be improved.

Second Embodiment

A chair according to this embodiment shown in FIGS. 7 to 10 has substantially the same basic construction as the chair according to the foregoing embodiment shown in FIG. 1. Specifically, the chair according to this embodiment has a slide mechanism X2 in association with a seat portion 110 and a seat support 120 for causing the seat portion 110 to slide back and forth. Since the chair has a backrest portion 6, a back support pillar 7, a leg portion 8 and a lumbar support 1 which are generally common to the first embodiment, only the features that are different from those of the first embodiment will be mainly described in detail hereinafter.

The seat support 120 comprises a pair of right and left seat frames 121 extending substantially horizontally in the fore-and-aft direction and each having a front end portion supported by a support member and a rear end portion supported by the back support pillar, and fore and rear coupling members 1221 and 1222 interconnecting the front end portions and the rear end portions, respectively, of the pair of seat frames 121. Substantially similarly to the seat frames of the first embodiment, the seat frames 121 are each a channel bar having a top wall 1211, an outer wall 1212 and an inner wall 1213 and U-shaped in section with an opening oriented downward. The fore and rear coupling members 122 have outwardly oriented faces joined with the inner walls 1213 of the seat frames 121 by welding or the like to reinforce the seat frames 121. Between the rear end portions of the seat frames 121 is provided a plate-shaped rear seat support 130 extending rearwardly upwardly with an inclination, which is of the same configuration as the rear seat support of the first embodiment.

As in the first embodiment, the seat portion 110 includes a seat body 111 having a cushioning property, a rigid seat plate 112 fitted to the reverse side of the seat body 111 so as to support a portion of the seat body 111 from a front end portion 111*a* to a location slightly rearward of a central portion, and a rear seat plate 113 supporting a rear end portion 111*b* of the seat body 111. In this embodiment also, an upwardly oriented surface of the seat body 111 which can substantially support a body part from the buttocks to the thighs of a sitter is determined as a seating surface A2. Since the seat plate 112 and the rear seat plate 113 are also the same as those of the first embodiment in their specific configurations, detailed description thereof is omitted here. This embodiment is also similar to the first embodiment in the features that: the rear seat plate 113 defines slots 1132 through which pins P attached to the seat frames 121 and the rear seat support 130 are inserted; the rear seat plate 113 is formed with a plurality of grooves 1131 arranged parallel in the fore-and-aft direction; and a movable range restricting section V2 comprising a bracket 1121 defining a slot 1121*c* and a pin 123 inserted through the slot 1121*c* is formed between the seat plate 112 and a seat frame 121. Further, this embodiment is similar to the first embodiment in the arrangement that a pin 162*a* of the lumbar support 162 is movably supported within a hole portion 1311 of a bracket located at an upper end portion of the rear seat support 130 to allow the angle of inclination of the rear end portion of the seat portion 110 to vary with rotation of the lumbar support 162.

The slide mechanism X2 in this embodiment comprises a pair of rack gears RG2 mounted on the seat plate 112, and a pair of pinion gears PG2 mounted on the seat support 120 so as to mesh with the rack gears RG2. The rack gears RG2 are each shaped into an elongate plate having a downwardly oriented face formed with a plurality of teeth arranged parallel in the fore-and-aft direction and an upwardly oriented face secured to side end portions of a downwardly oriented face of a thin fitting plate 124 by bonding or the like, the fitting plate 124 being mounted on the reverse side of the seat plate 112 at a substantially central portion in the fore-and-aft direction by any appropriate means such as screwing. On the other hand, the pinion gears PG2 are each disk-shaped having a peripheral wall formed with teeth with a pitch equal to that of the rack gears RG2 and are each located in the space between the outer wall 1212 and the inner wall 1213 of each seat frame 121 and rotatably supported by a horizontal support shaft b extending through both the two walls. The top wall 1211 of each seat frame 121 defines an opening window 1214 shaped rectangular in plan view and extending therethrough in the thicknesswise direction, an upper end portion of each pinion gear PG2 protruding from the opening window 1214. The right and left pinion gears PG2 share the horizontal support shaft b to operate synchronously with each other, one end portion of the horizontal support shaft b extending to protrude laterally outwardly of one seat frame 121.

The seat support 120 is provided with a restraining section Y2 for releasably restraining the sliding movement of the seat portion 110 caused by the slide mechanism X2 and a manipulating section Z2 for operating the restraining section Y2 to switch the seat portion 110 between a slidable condition and a locked condition.

The restraining section Y2 comprises a stopper gear SG2 attached to the outer wall 1212 of the seat frame 121 on the side where the horizontal support shaft b protrudes, and stopper pins 150 that can retractably protrude longitudinally of the horizontal support shaft b to engage the stopper gear SG2. The stopper gear SG2 is substantially disk-shaped having a through-hole SG2*b* through which the horizontal support shaft b extends and a peripheral wall formed with a plurality of arch-shaped continuous dent portions SG2*a*. The stopper pins 150 are each shaped cylindrical having a radius substantially equal to that of each dent portion SG2 and are attached to a peripheral edge portion of a disk-shaped fitting plate 151 that has a central portion through which the horizontal support shaft b extends and is located outwardly beyond the stopper gear SG2. The fitting plate 151 is attached with three such stopper pins 150 with substantially equal phase angle shift. The fitting plate 151 is further fitted at its outer face 151*a* with a cylindrical tubular member 152 receiving the horizontal support shaft b therein, the tubular member 152 being attached at its outer end portion to an inner wall 141 of a manipulating grip 140 having a radius one size larger than that of the tubular member 152. This manipulating grip 140 forms a manipulating section Z2 of this embodiment. The manipulating grip 140 has an outer end portion 140*a* opening to expose the inside thereof. The horizontal support shaft b has a side end portion bx shaped into a rectangular plate and inserted into through-hole 141*a* having a substantially rectangular opening in a substantially central portion of the inner wall 141 of the manipulating grip 140. With such an arrangement, the manipulating grip 140 can be moved to the right and left horizontally along the horizontal support shaft b together with the fitting plate 151 fitted with the tubular member 152 and the stopper pins 150. Further, a spring SP2 as an elastic member disposed to embrace the side end portion bx of the horizontal support shaft b is fixed at its one end to the internal face of the inner wall 141 of the manipulating grip 140 and at the other end to a disk 142 located within the manipulating grip 140 and fixed to the side end portion bx of the horizontal support shaft b with a screw 143. This spring SP2 presses the stopper pins SG2 through the inner wall 141 of the manipulating grip 140, the tubular member 152 and the fitting plate 151 in such a direction that they become fitted into the dent portions SG2*a* of the stopper gear SG2.

In a usual condition of such an arrangement where there is no manipulation of the manipulating grip 140, the stopper pins 150 pressed by the elastic force of the spring SP2 are fitted in the dent portions SG2*a* of the stopper gear SG2 fixed to the seat frame 121 to prevent the manipulating grip 140 and the horizontal support shaft b from rotating, with the result that the pinion gears PG2 are also restrained from rotating and, hence, the seat portion 110 is unslidably locked. On the other hand, when the manipulating grip 140 is pulled outwardly in the direction indicated by arrow in FIG. 8 or FIG. 10 against the elastic force of the spring SP2, the stopper pins 150 are also moved outwardly to release the fitting relation with the stopper gear SG2. When the manipulating grip 140 is rotated forwardly or backwardly under this condition, the side end portion bx of the horizontal support shaft b comes to abut the through-hole 141*a* defined in the manipulating grip 140, so that the horizontal support shaft b rotates in the same direction as the rotation of the manipulating grip 140. As the horizontal support shaft b rotates, the pinion gears PG2 also rotate in the same direction to cause the rack gears RG 2 to be gear-fed in the fore-and-aft direction. As a result, the seat portion 110 slides back and forth whereby the adjustment of the depth of the seating surface A2 becomes possible. Under this condition the spring SP2 contracts between the inner wall 141 of the manipulating grip 141 and the disk 142 to accumulate its elastic force and, hence, releasing a hand from the manipulating grip 140 causes the stopper pins 150 to become fitted into the dent portions SG2*a* of the stopper gear SG2 by the elastic force of the spring SP2 thereby restraining the sliding movement of the seat portion 110 at a position to which the depth of the seating surface A2 is adjusted as described above.

This embodiment is similar to the first embodiment in that it provides the effects that: the slidable range of the seat portion 110 can be restricted within the extent of opening of slot 1121*c* in the movable range restricting section V2; the pins P inserted through the slots 1132 defined at the rear seat plate 113 prevent the rear seat plate 113 and the rear end portion of the seat body 111 from lifting off; and when the rear end portion of the seat portion 110 gradually rises along the rear frame, the grooves 1131 of the rear seat plate 113 allow the seat portion 110 to maintain its proper shape, and like effects.

As described above, the chair according to this embodiment is also capable of causing the seat portion 110 to slide back and forth by means of the slide mechanism X2 arranged such that the rack gears RG2 located at the seat portion 110 move back and forth with rotation of the pinion gears PG2 located at the seat support 120 and, hence, the sitter is capable of adjusting the depth of the seating surface A2 according to his or her own build so as to sit on the chair with a proper posture. Further, since it is possible to releasably restrain the sliding movement of the seat portion 110 at the position adjusted by the sitter by means of the restraining section Y2 formed in association with the seat portion 110 and the seat support 120, the seat portion 110 will not move unexpectedly when the sitter is sitting thereon. Furthermore, since the rear end portion of the seat portion 110 moves so as to gradually rise along the rear seat support 130 extending as inclining rearwardly upwardly relative to the seat support 120, the rear end portion of the seat portion 1 does not protrude rearward ill-fittingly, so that the appearance of the chair is not impaired.

Moreover, since selective switching between the movable condition and the restrained state of the seat portion 110 by means of the restraining section Y2 is achieved through the manipulating section Z2 that is located at the seat portion 110 so as to be slidable with the sliding movement of the seat portion 1, the operation of restraining the sliding movement of the seat portion 110 or releasing the restraint can be achieved at a fixed position irrespective of the position to which the seat portion 110 has slid. Further, the restraining section Y2 is arranged such that an operation of the manipulating section Z2 causes the stopper pins 150 to retractably protrude so as to become fitted into the dent portions SG2*a* of the stopper gear SG2 fixedly attached to the seat support 120 thereby restraining the rotation of the pinion gears PG2. With such a simple arrangement, it is possible to allow the rack gears RG2 to move back and forth with rotation of the pinion gears PG2 or restrain the movement of the rack gears RG2 and, hence, it is possible to realize the sliding movement of the seat portion 110 and the restraint of the sliding movement. The restraining section Y1 of such an arrangement is constructed such that: the spring SP2 is provided for pressing the stopper pins 150 in such a direction that the pins 150 become fitted into the dent portions SG2*a* of the stopper gear SG2; and the pinion gears PG2 are rotated by manipulating the manipulating section Z2 against the elastic force of the spring SP2. Thus, as in the case of the first embodiment, the seat portion 110 usually assumes its unslidable condition through the elastic force of the spring SP2, whereby the stability of the seat portion 110 on which the sitter is sitting can be improved.

It should be noted that the present invention is not limited to the foregoing embodiments. That is, it is possible to combine the restraining section and manipulating section of the second embodiment with the slide mechanism of the first embodiment in order to achieve the restraint of sliding movement of the seat portion and the release of the restraint, and vice versa. Though the foregoing embodiments use the seat support and the rear seat support as separate members, these members may be formed into an integral member for supporting the seat portion. Further, it is possible to combine a restraining section or manipulating section arranged differently than described above with the slide mechanism of each of the foregoing embodiments.

Third Embodiment

Figure 11:
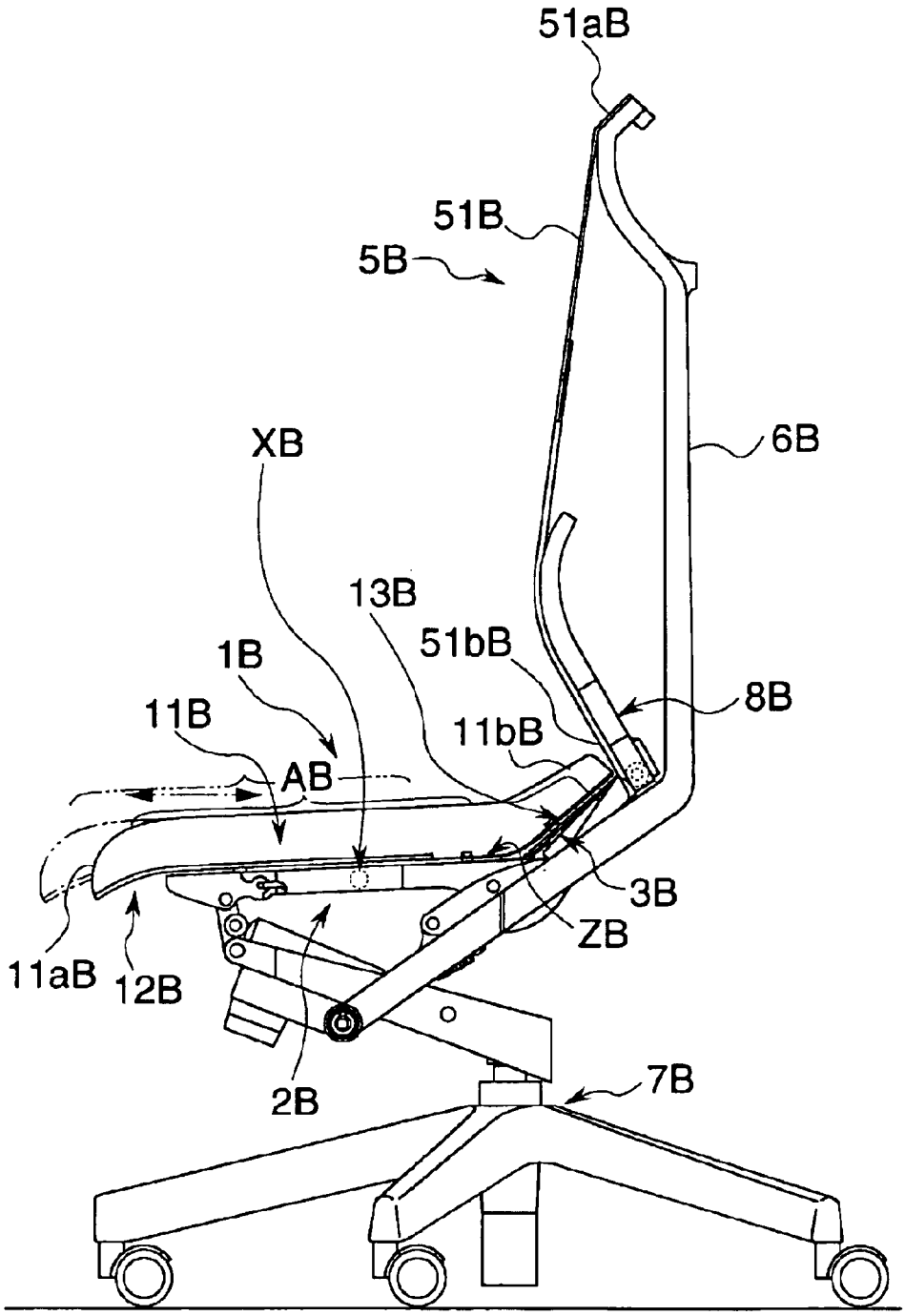
FIG. 11 is a side elevational view showing a third embodiment of the present invention.
Figure 12:
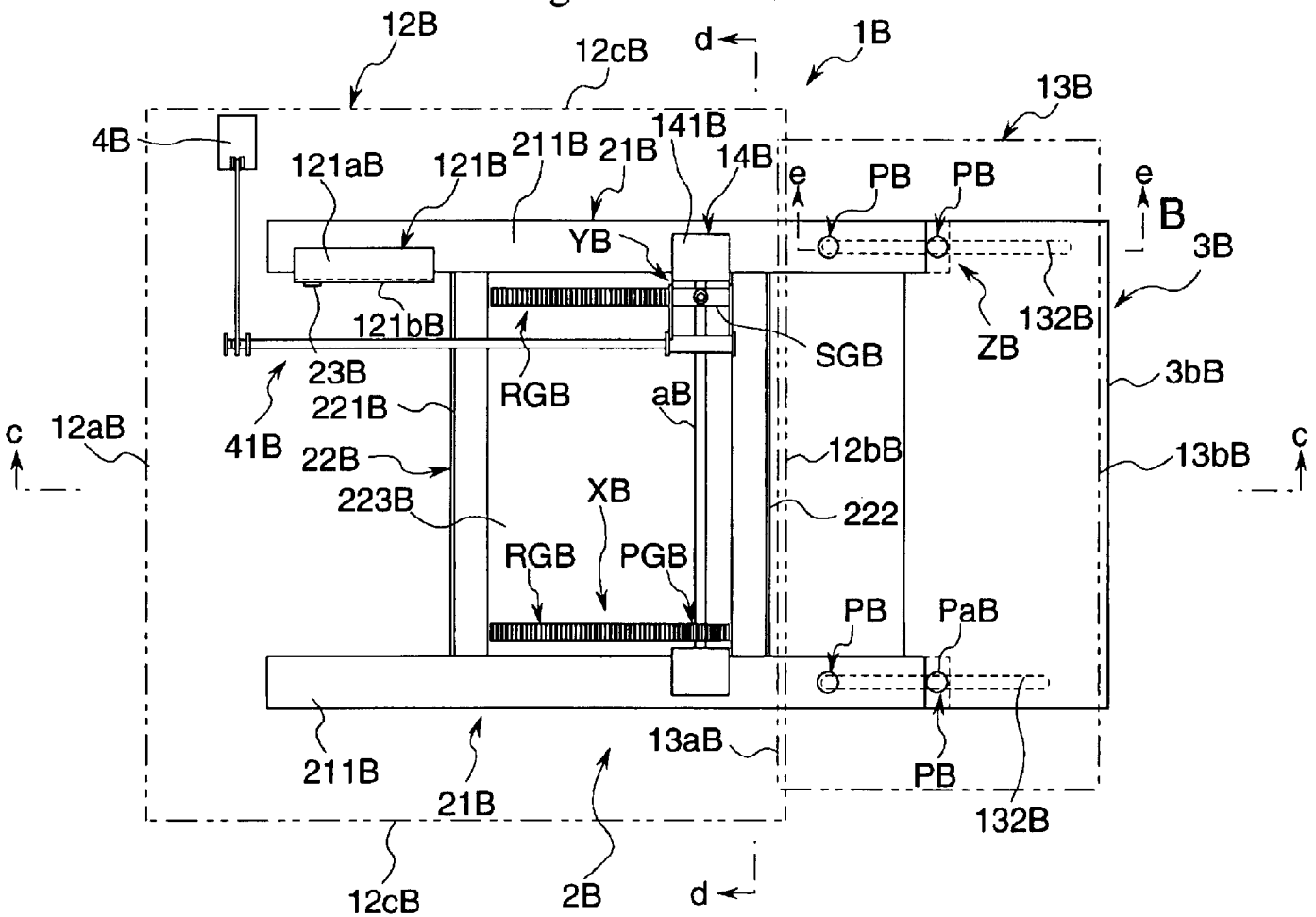
FIG. 12 is a partially cutaway plan view showing a seat portion in the same embodiment.
Figure 13:
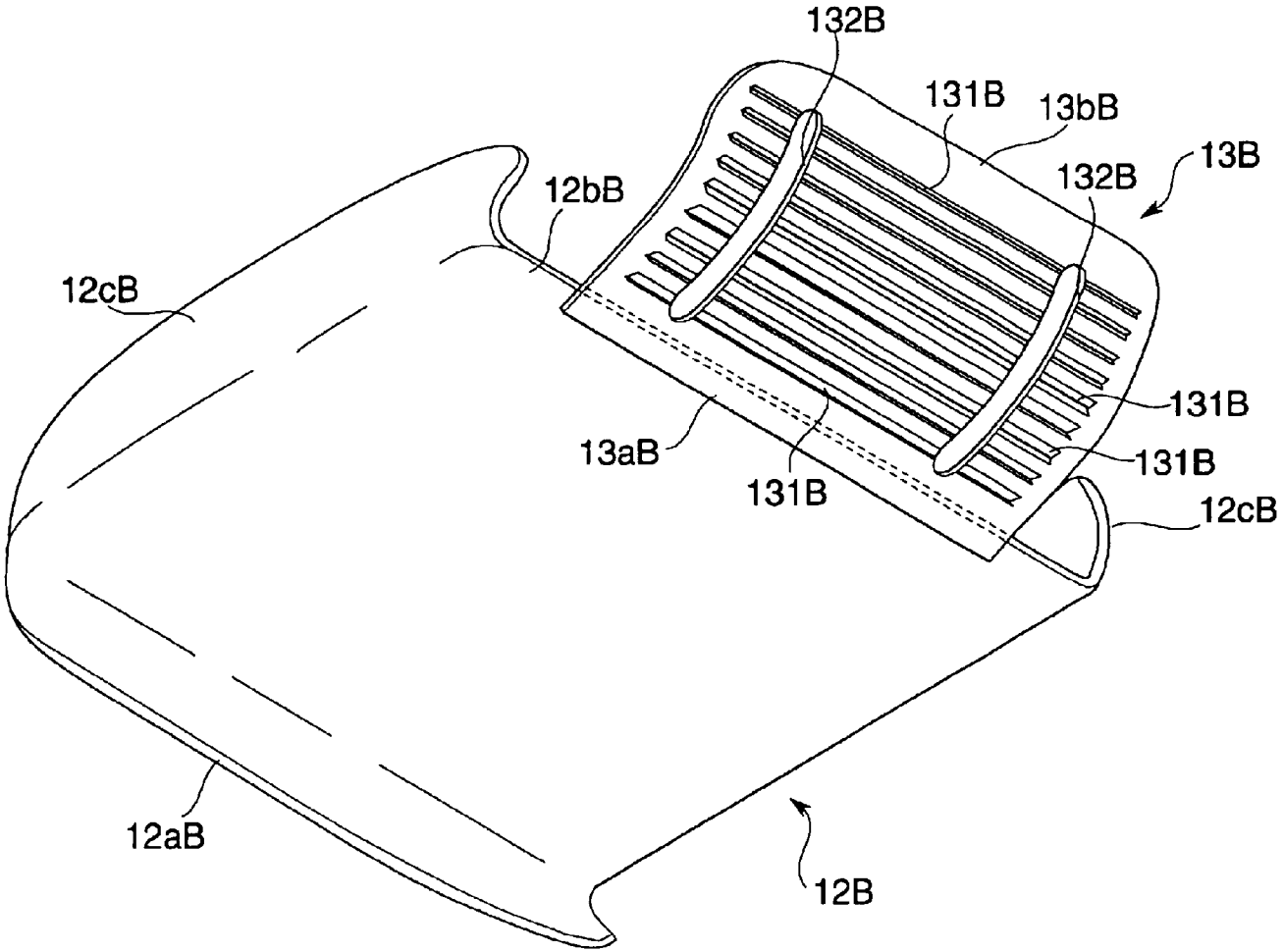
FIG. 13 is a perspective view, as viewed from below, showing a seat plate and a rear seat plate in the same embodiment.
Figure 14:
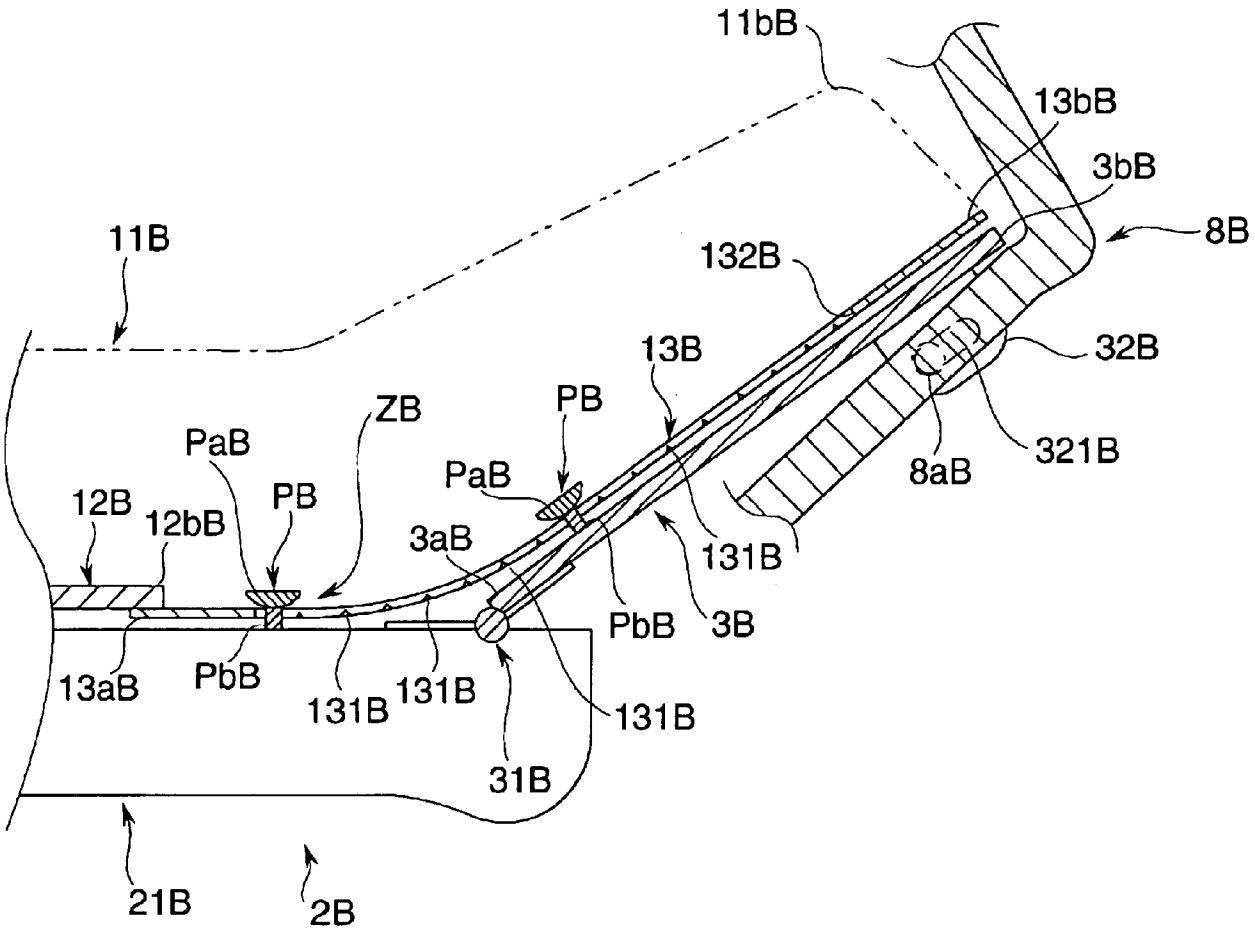
FIG. 14 is a sectional view taken on line c—c in FIG. 12.
Figure 15:
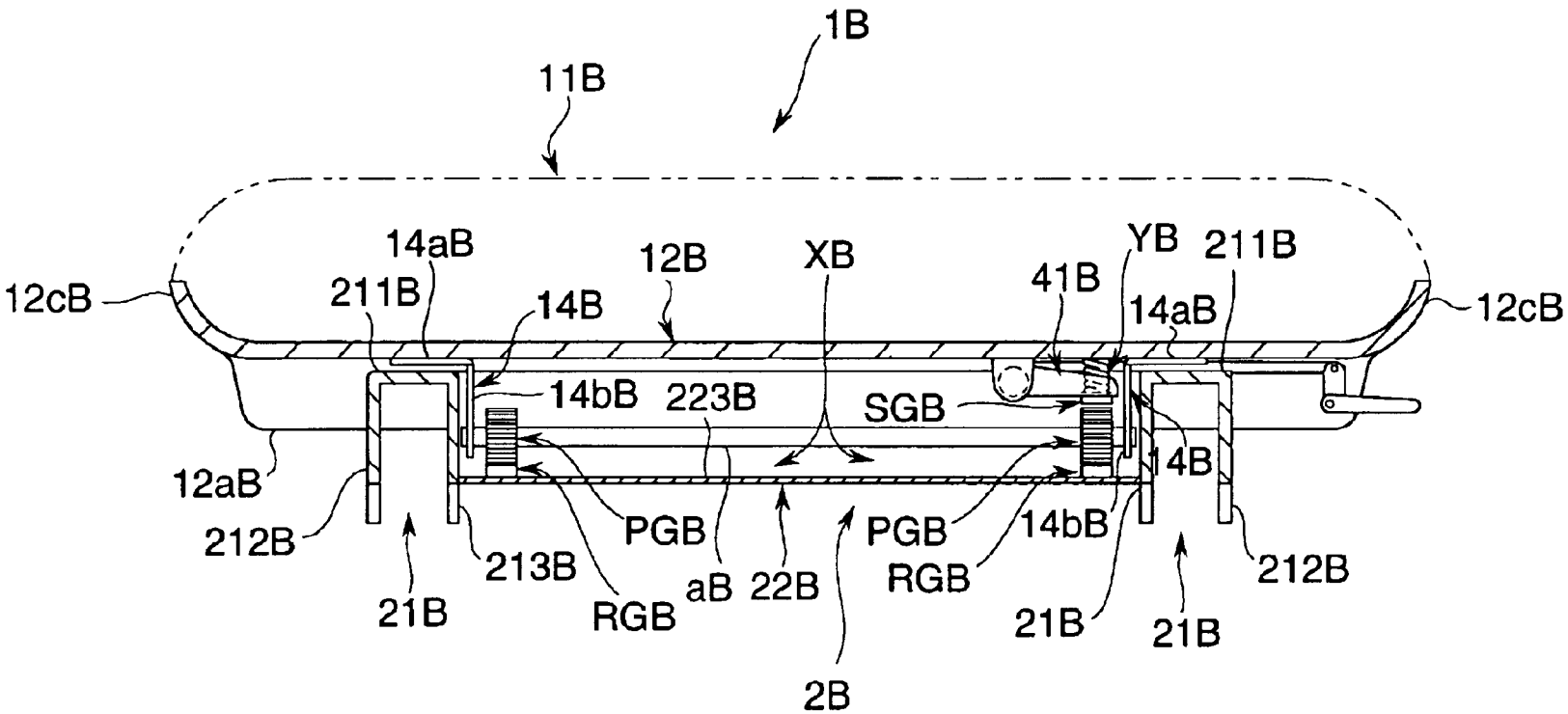
FIG. 15 is a sectional view taken on line d—d in FIG. 12.

As shown in FIG. 11, a chair according to the third embodiment includes a seat portion 1B, a backrest portion 5B, a seat support 2B supporting the seat portion 1B, a back support pillar 6B supporting the backrest portion 5B, and a leg portion 7B contacting a floor surface and supporting the seat support 2B and the back support pillar 6B. In association with the seat portion 1B and the seat support 2B there is provided a slide mechanism XB as a moving mechanism for causing the seat portion 1B to slide in the fore-and-aft direction in order to adjust the depth of a seating surface AB that can effectively support a body part from the buttocks to the thighs of a sitter according the build of the sitter. On an upper end portion of the leg portion 7B is mounted a substantially V-bent lumbar support 8B so as to be rotatable forwardly and backwardly. This lumbar support 8B, which serves to support the waist of the sitter, supports a lower end portion 51*b*B of an upholstery member 51B of the backrest portion 5B from behind. An upper end portion 51*a*B of this upholstery member 51B is attached to an upper end portion of the back support pillar 6B.

As shown in FIGS. 12 to 15, the seat support 2B includes a pair of right and left seat frames 21B each having a front end portion supported by the leg portion 7B and a rear end portion supported by the back support pillar 6B, the seat frames 21B extending substantially horizontally in the fore-and-aft direction, and a coupling member 22B interconnecting the two seat frames 21B. The seat frames 21B are each a channel bar having a top wall 211B, an outer wall 212B and an inner wall 213B and U-shaped in section with an opening oriented downward. The coupling member 22B is shaped like a vessel having a front wall 221B, a rear wall 222B and a bottom wall 223B, and outwardly oriented faces of these walls are joined with the inner walls 213B of the seat frames 21B by welding or the like to reinforce the seat frames 21B. Between the rear end portions of the seat frames 21B is rotatably mounted a lower end portion of a planar plate-shaped rear seat support 3B extending rearwardly upwardly with an inclination through a hinge 31B. The rear seat support 3B has an upper end portion 3*b*B fitted with a downwardly oriented plate-shaped bracket 32B defining a hole portion 321B extending therethrough to the right and left, into which a pin 8*a*B located at the bent portion of the lumbar frame is movably inserted to interconnect the rear seat support 3B and the lumbar support 8B.

On the other hand, as shown in FIGS. 12 to 15, the seat portion 1B includes a seat body 11B having a cushioning property, a rigid seat plate 12B fitted to the reverse side of the seat body 11B so as to support a part of the seat body 11B from a front end portion 11*a*B to a location slightly rearward of a central portion, and a rear seat plate 13B supporting a rear end portion 11*b*B of the seat body 11B. A region of an upwardly oriented face of the seat body 11B which can substantially support a body part from the buttocks to the thighs of the sitter is determined as a seating surface AB. The seat body 11B is covered with a cover material not shown.

The seat plate 12B is plate-shaped having side end portions 12*c*B curved upward to hold not only the reverse side but also side portions of the seat body 11B and a front end portion 12*a*B gently curved downward to align with the legs of a sitter. A bracket 121B, L-shaped in front view, has a top wall 121*a*B attached to a portion extending along one side end portion 12*c*B on the reverse side of the front end portion 12*a*B of the seat plate 12B by screwing from below, and a side wall 121*b*B defining a slot 121*c*B extending therethrough in the thicknesswise direction and elongated in the fore-and-aft direction. Through the slot 121*c*B is inserted a pin 23B attached to the inner wall 213B of the corresponding seat frame 21B to allow the seat portion 1B to slide relative to the seat support 2B within a range allowing the slot 121*c*B to move back and forth along the pin 23B together with the seat plate 12B thereby defining the movable range of the seat portion 1B.

The rear seat plate 13B, formed of a flexibly deformable thin resin plate, is surface-supported on the rear seat support 3B, has a front end portion 13*a*B fitted to a rear end portion 12*b*B of the seat plate 12B and holds substantially entire rear end portion 11*b*B side of the seat body 11B from below. The rear seat plate 13B has a reverse side formed with a plurality of groove portions 131B arranged at a predetermined interval in the fore-and-aft direction and each extending widthwise, that is, in a direction perpendicularly intersecting the sliding direction of the seat portion 1B. These groove portions 131B are each formed into a substantially triangular configuration in side view to open downward by carving the reverse side of the rear seat plate 13B. The rear seat plate 13B is further formed with a pair of right and left slots 132B extending through the thickness of the rear seat plate 13 and each elongated across the plurality of grooves 131B in the fore-and-aft direction. These slots 132B are formed so as to be located just above respective seat frames 21B. Since the rear seat plate 13B is surface-supported on the rear seat support 3B as described above, the rear seat plate 13B maintains a certain bearing strength even if a relatively thin resin material is employed therefor.

Figure 16:
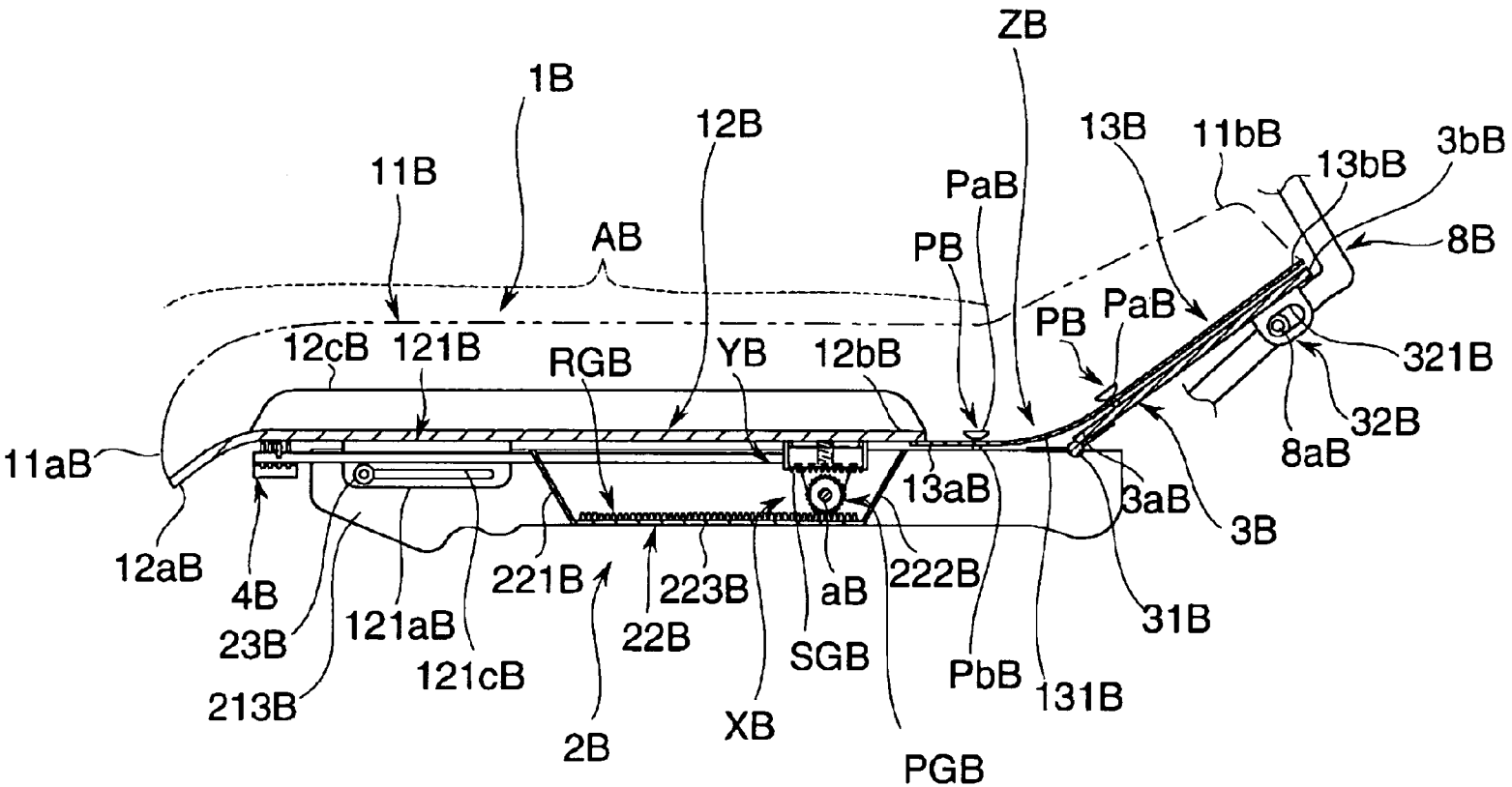
FIG. 16 is a sectional view taken on line e—e in FIG. 12.

As shown in the enlarged view at FIG. 16, a lift-off inhibiting section ZB is formed between the rear seat plate 13B and the seat supports including the seat support 2B and the rear seat support 3B for inhibiting the rear seat plate 13B to lift off during the sliding movement of the seat portion 1B. Specifically, the lift-off inhibiting section ZB comprises the slots 132B defined at the rear seat plate 13B and pins PB attached to the rear end portions of the seat frames 21B and the lower end portion 3*a*B of the rear seat support 132B, respectively so as to be inserted into the slots 132B. Each of the pins PB has a head portion PaB having a diameter greater than the transverse width of opening of each slot 132B, and a shank portion PbB extending through the slot 132B. In mounting the seat portion 1B on the seat support 2B and the rear seat support 3B, the shank portion PbB of each pin PB is inserted through the corresponding slot 132B so that the head portion PaB is located on the obverse side of the slot 132B, whereby the rear seat plate 13B is depressed downward with the underside of the head portion PaB.

As shown in FIGS. 12 to 15, on the other hand, the slide mechanism XB comprises a pair of rack gears RGB mounted on the seat support 2B, and a pair of pinion gears PGB mounted on the seat portion 1 so as to mesh with respective rack gears RGB. The rack gears RGB are each shaped into an elongate plate with a plurality of teeth arranged parallel in the fore-and-aft direction on an upwardly oriented face thereof and are secured to side end portions of an upper face of the bottom wall 223B of the coupling member 22B. The pinion gears PGB are each disk-shaped having a peripheral wall formed with teeth with a pitch equal to that of the rack gears RGB and are each rotatably mounted on a side wall 142B of a bracket 14B that is L-shaped in front view through a horizontal support shaft aB. The bracket 14B has a top wall 141B screwed to the seat plate 12B from below. The right and left pinion gears PGB share the horizontal support shaft aB to operate synchronously with each other. The slide mechanism XB is further provided with restraining means YB for inhibiting the pinion gears PGB to rotate at any desired position to which the pinion gears PGB have moved in the fore-and-aft direction while rotating along the rack gears RGB thereby restraining the sliding movement of the seat portion 1B. The restraining means YB has a stopper gear SGB that is upwardly and downwardly movable selectively in a direction toward and away from the corresponding pinion gear PGB to come into mesh with the corresponding pinion gear PBG when a manipulating lever 4B disposed under the front end portion 12*a*B of the seat plate 12B is manipulated to rotate upwardly or downwardly. That is, the manipulating lever 4B and the stopper gear SGB are connected to each other through a connecting portion 41B adapted to convert the rotation of the manipulating lever 4B into the up and down movement of the stopper gear SGB, so that selective switching between the slidable condition and the restrained condition of the seat portion 1B can be made through an operation of the manipulating lever 4B.

After the pinion gears PGB are made rotatable by moving the stopper gear SGB upwardly through an operation of the manipulating lever 4B, rotating the pinion gears PGB along the rack gears RGB to move the seat portion 1B back and forth causes the bent position of the rear seat plate 13B to change. At this time, groove portions 131B at a part with a sharper curvature open larger in the fore-and-aft direction, while groove portions 131B at other parts open or close to such degrees as to accommodate curvatures of those parts, whereby the entire rear seat plate 13B curves smoothly. As a result, the rear end portion 11*b*B of the seat portion 11B which is held by the rear seat plate 13B follows the rear seat plate 13B, so that the rear end portion 11*b*B is smoothly and continuously curved without forming wrinkles of projection-depression shape on an upper surface at a base end portion from which the rear end portion 11*b*B gradually rises rearward. Further, when the slots 132B of the rear seat plate 13B move back and forth along the pins PB attached to the seat support 2B and the rear seat support 3B with the sliding movement of the seat portion 1B, the rear seat plate 13B, which is depressed downward by the head portions PaB of the pins, does not lift off thereby preventing the seat body 11B from lifting off the seat support 2B and the rear seat support 3B. It is to be noted that the smoothness of the upper surface of the seat body 11B is still maintained under the condition that the movement of the seat portion 1B is restrained through an operation of the manipulating lever 4B to cause the stopper gear SGB to mesh with the pinion gear PGB at a position where the depth of the seating surface AB is adjusted according to the build of a sitter.

Further, the chair according to this embodiment is capable of forwardly pressing the lower end portion 51*b*B of the upholstery member 51B of the backrest portion 5B so that the sitter assumes a posture with his or her waist pressed forwardly if the lumbar support 8B is rotated forwardly or backwardly about its lower end portion supported on the leg portion 7B at a position where the depth of the seating surface AB is appropriately adjusted through the slide mechanism XB. Specifically, when the lumbar support 8B is rotated forwardly, the pin 8*a*B located at the lumbar support 8B moves upwardly within the hole portion 321B defined at the bracket 32B of the rear seat support 3B. At this time the lumbar support 8B presses the rear seat support 3B forwardly upwardly from below, so that the rear seat support 3B rotates forwardly about the hinge 31B at the lower end portion 3*a*B. In this case also, the rear seat plate 13B becomes smoothly curved at a sharper curvature while enlarging the width of opening of the groove portions 131B and, hence, the seat body 11B following the rear seat plate 13B also becomes smoothly curved without forming wrinkles of projection-depression shape at a base end portion from which the rear end portion of the seat body 11*b* gradually rises even when the angle of rearward inclination of the seat body 11B becomes high, whereby the chair offers a good sitting comfort to the sitter.

As described above, the chair according to this embodiment is capable of offering a good sitting comfort to a person sitting thereon without giving him or her a sense of incongruity because even when the seat portion 1B is caused to slide back and forth to adjust the depth of the seating surface AB of the seat body 11B according to the build or posture of the sitter, the rear seat support 3B (sic) holding the rear end portion 11*b*B of the seat body 11B and gradually rising along the rear seat support 3B becomes continuously and smoothly curved while varying the width of opening of the groove portions 131B depending on the inclination of the rear seat support 3B, so that the rear end portion 11*b*B of the seat body 11B gradually rises along the rear seat support 3B while curving smoothly without forming wrinkles of projection-depression shape. Further, since the front end portion 11*a*B side of the seat body 11B is held by the rigid seat plate 12B, the sitter does not directly feel the hardness of the seat frames 21B forming the seat support 2B at his or her thighs, not only the rear end portion 11*b*B of the seat body 11B but also the entirety of the chair is capable of giving a good sitting comfort to the sitter.

Particularly, since the groove portions 131B are formed by carving the reverse side of the rear seat plate 13B formed from resin, the formation of the rear seat plate 13B that is capable of smoothly curving can be made easily, while at the same time a portion holding the seat body 11B having a cushioning property can be made smooth by virtue of the provision of the groove portions 131B on the reverse side of the rear seat plate 13B.

Since the lift-off inhibiting section ZB is formed comprising the slots 132B defined at the rear seat plate 13B and the pins PB attached to the seat frames 21B and the rear seat support 3B, respectively and is arranged such that the slots 132B move back and forth along the shank portions PbB of the pins PB during the sliding movement of the seat portion 1B with the rear seat plate 13B being depressed downward by the head portions PaB of the pins PB, the rear seat plate 13B and the rear end portion of the seat body 11B will not lift off the seat support 2B and the rear seat support 3B when the seat portion 1B is moved to any position, whereby the sitter can sit on the chair with improved stability.

It should be noted that the present invention is not limited to the foregoing embodiment. The same effect as provided by the foregoing embodiment can be obtained if, for example, the groove portions of the rear seat plate are formed into a bellows configuration wherein alternate thick portions and thin portions are continuously arranged adjacent to each other in the fore-and-aft direction, or the lift-off inhibiting section comprises hook-shaped projections that are located at the seat support and the rear seat support so as to hold the rear seat plate therebetween from lateral sides. It is possible to employ a smooth planar plate member that is not necessarily formed with groove portions as the rear seat plate so long as the planar plate member has such strength as to support the rear end portion of the seat body firmly. Further, it is possible to form such groove portions on the obverse side as well as the reverse side of the rear seat plate. Moreover, a construction other than the foregoing slide mechanism may be employed as the moving mechanism.

Fourth Embodiment

Figure 17:
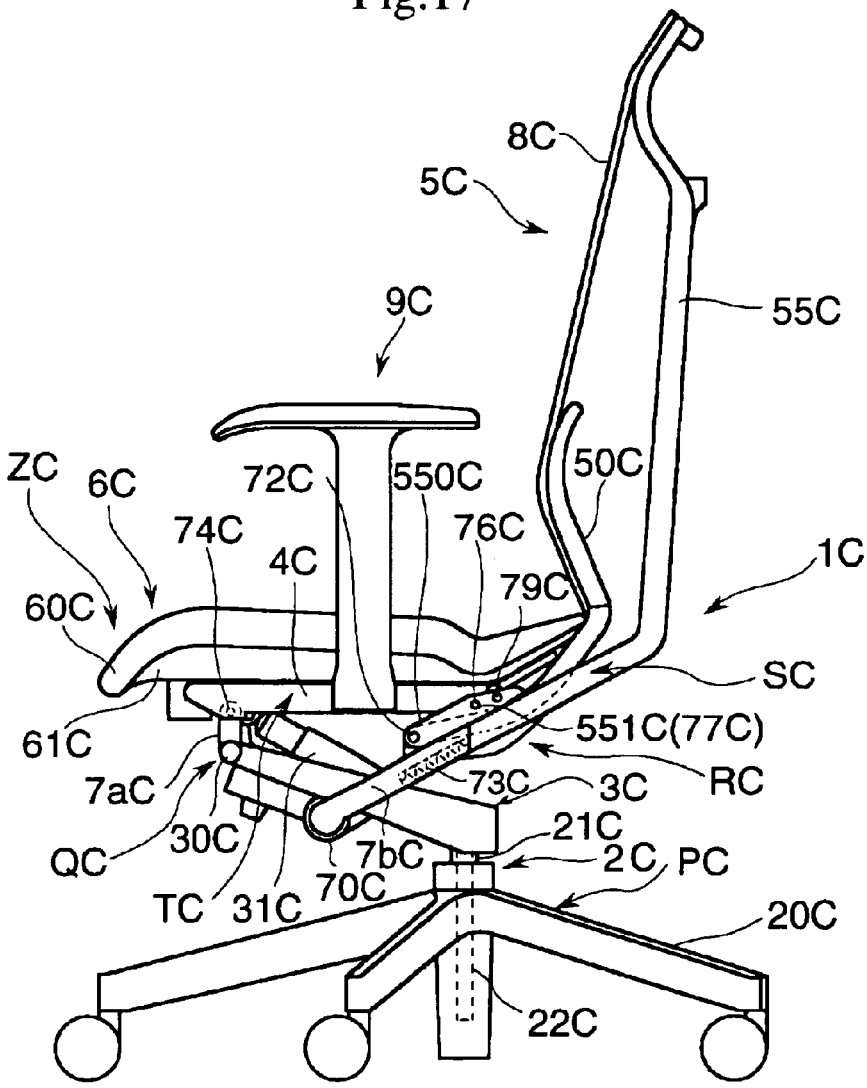
FIG. 17 is a side elevational view showing a fourth embodiment of the present invention.
Figure 18:
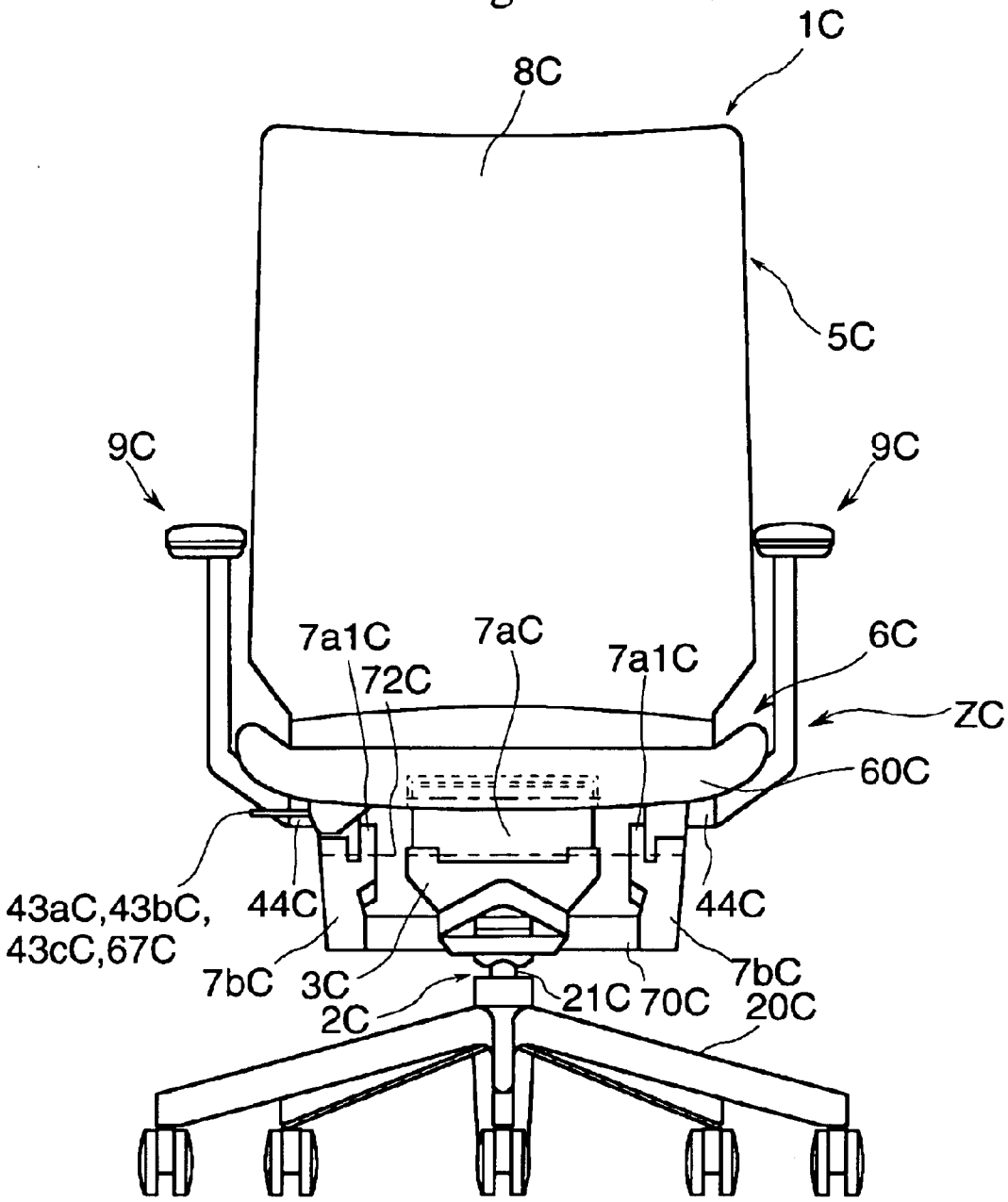
FIG. 18 is a front elevational view of the same embodiment.
Figure 19:
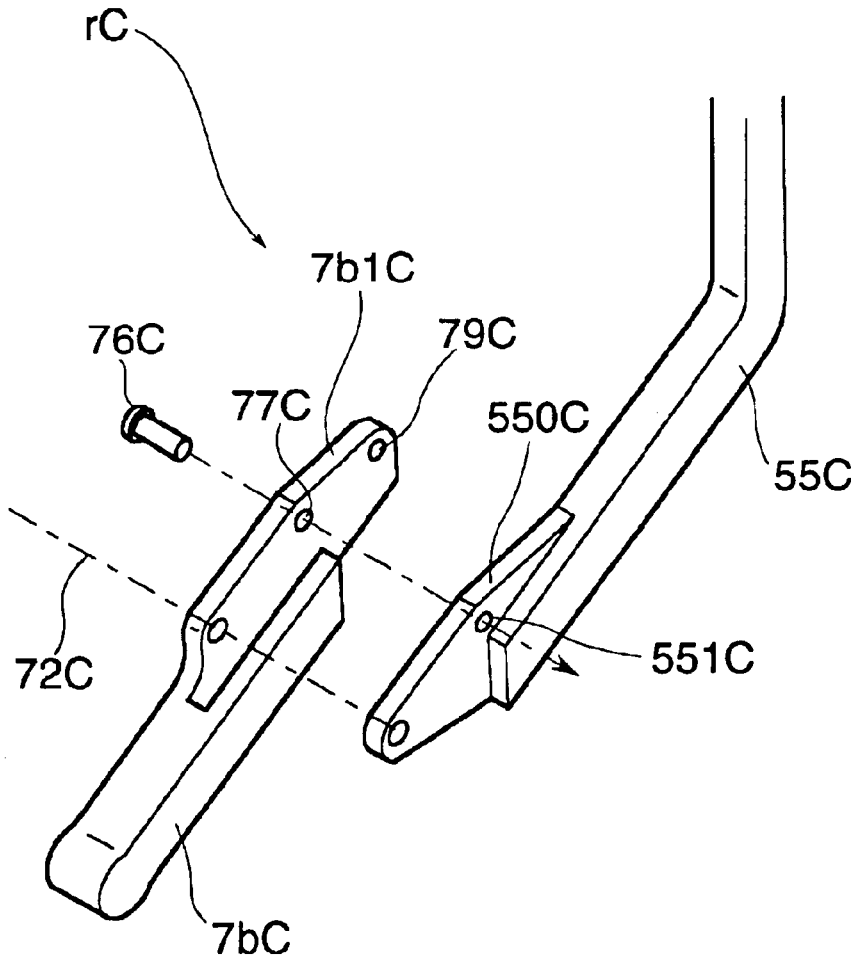
FIG. 19 is an exploded fragmentary view of the same embodiment.
Figure 20:
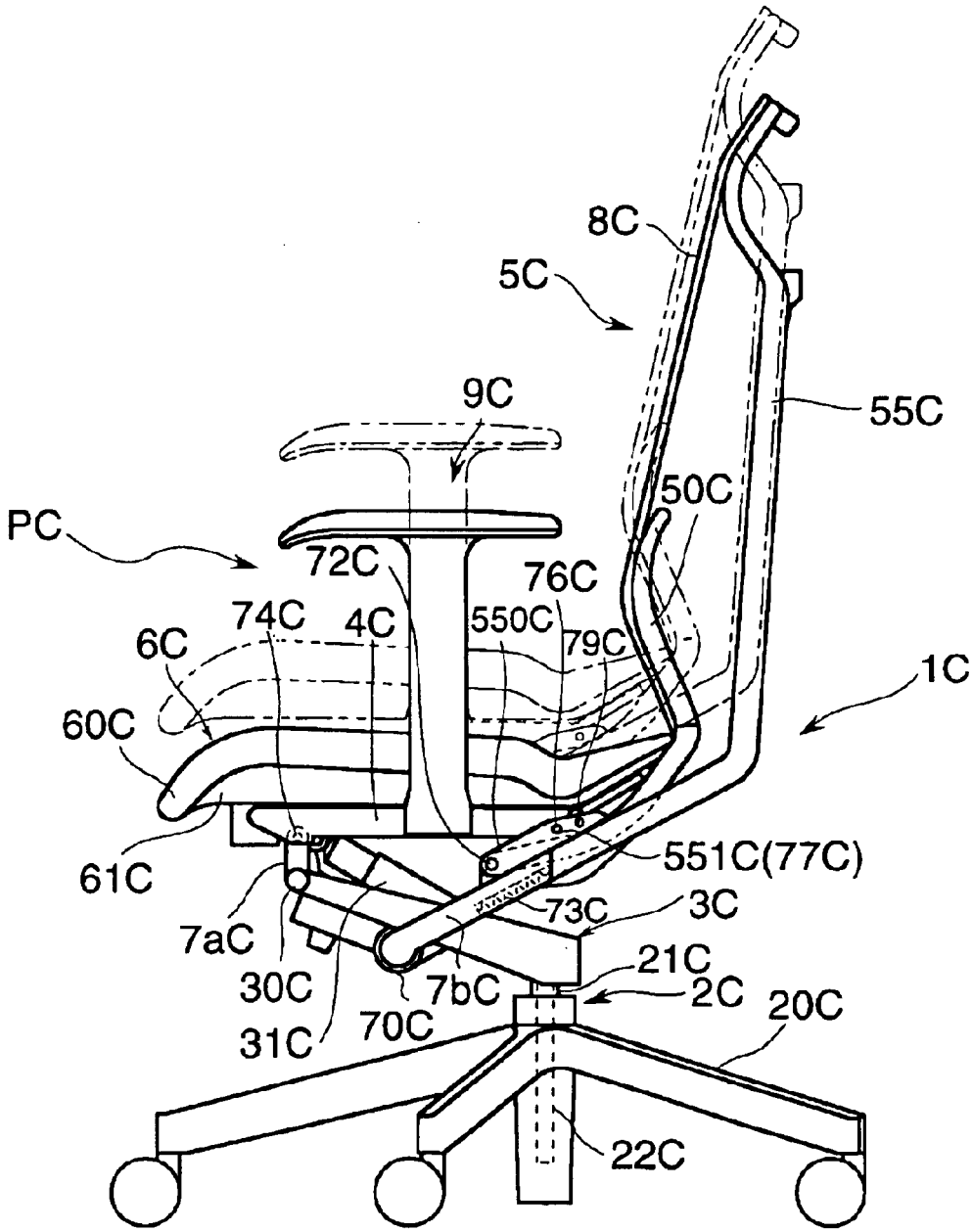
FIG. 20 is an explanatory view illustrating the operation of the same embodiment.
Figure 21:
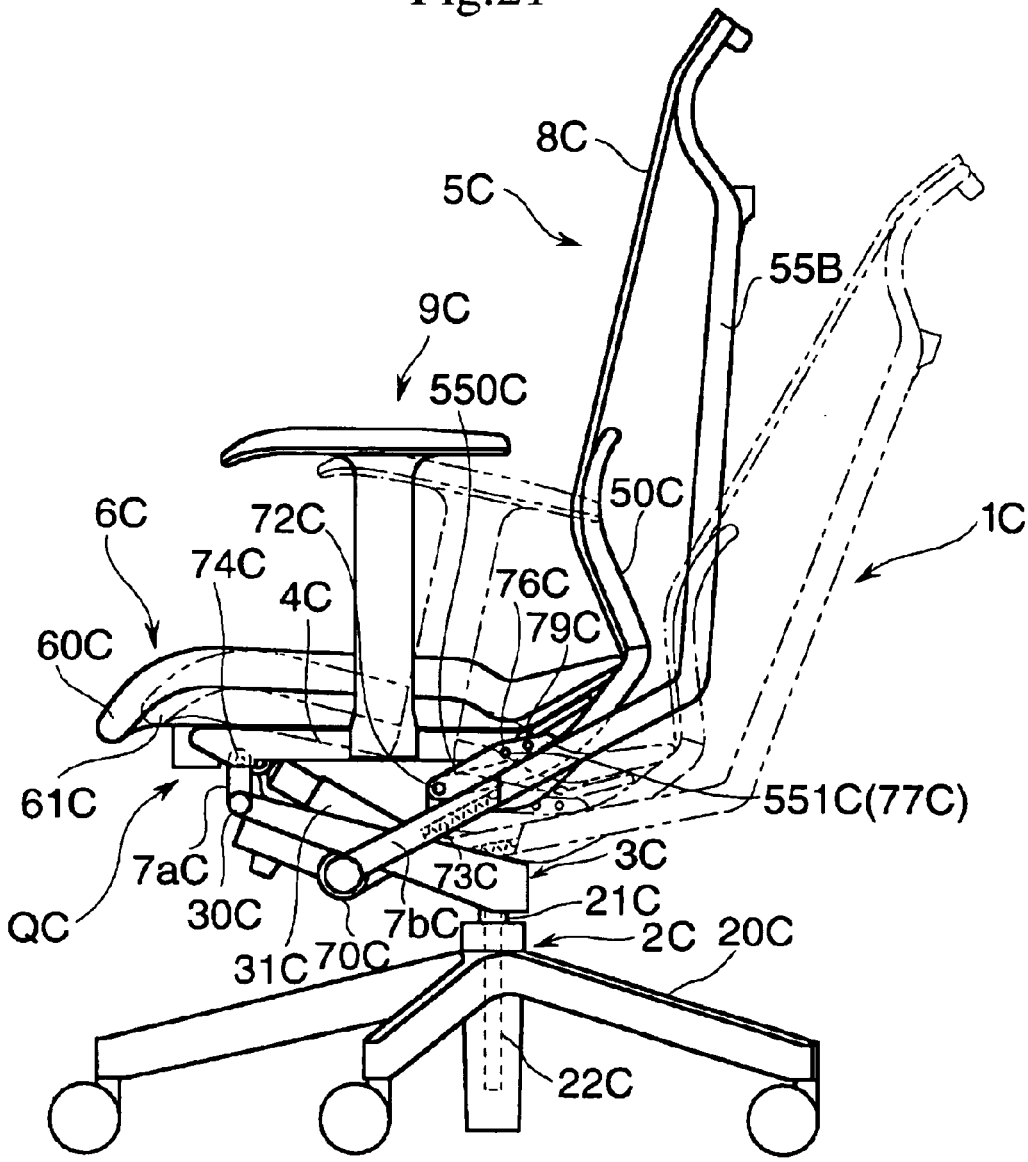
FIG. 21 is an explanatory view illustrating the operation of the same embodiment.
Figure 22:
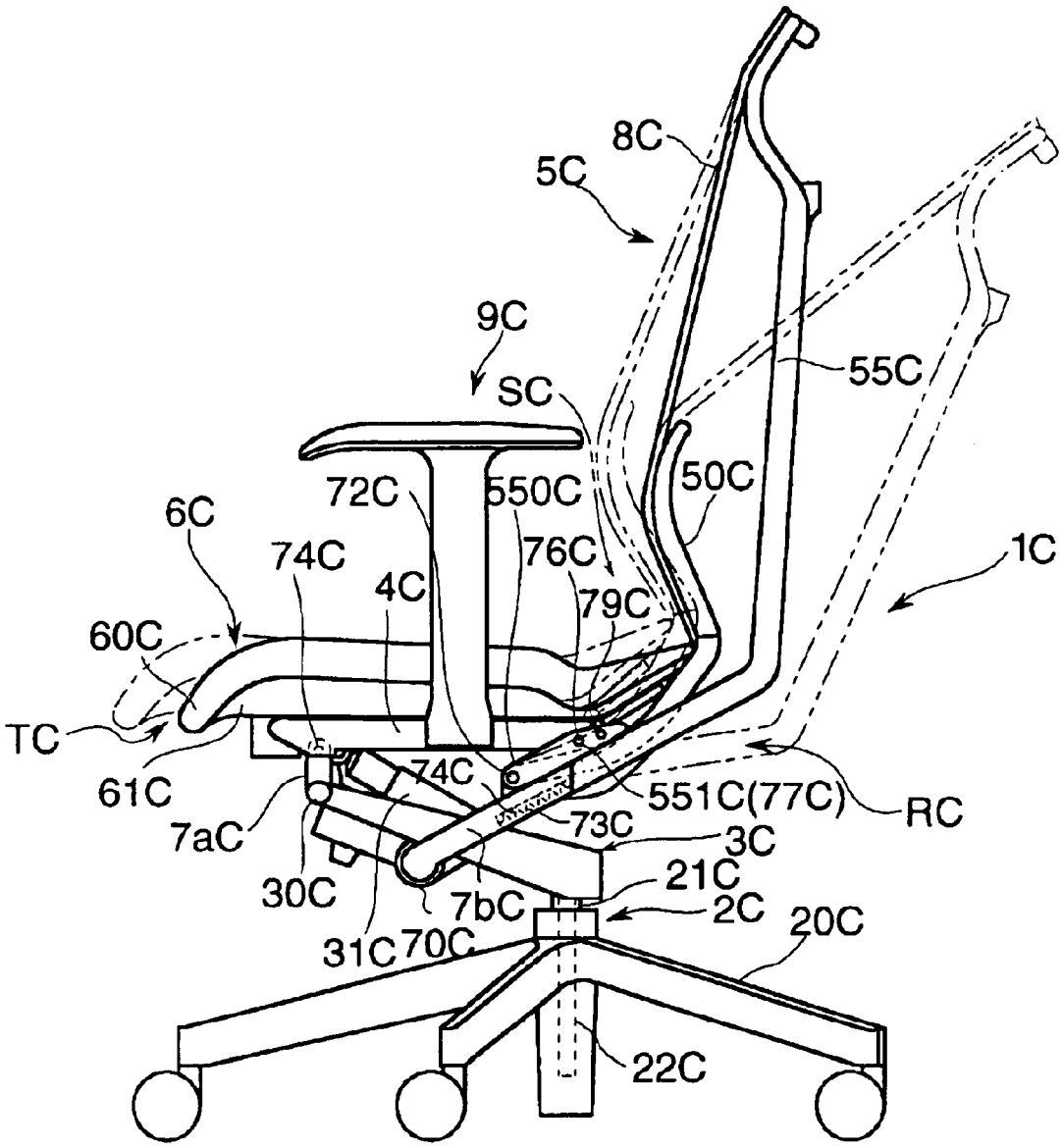
FIG. 22 is an explanatory view illustrating the operation of the same embodiment.

FIGS. 17 and 18 are a side elevational view and a front elevational view, respectively of a chair 1C according to the fourth embodiment of the present invention; FIG. 19 is an exploded fragmentary perspective view showing a functional part of the chair 1C; and FIGS. 20 to 22 are each an explanatory view of this chair.

The chair 1C comprises a backrest portion 5C and a seat portion 6C which are supported by a base leg 2C, and in order to be capable of selectively assuming a use posture suited to working or the like and postures suited to rest and refreshing, the chair 1C is provided at the base leg 2C or between the base leg 2C and the backrest portion 5C or the seat portion 6C or the like with a lifting mechanism PC for adjusting the height of the seat and backrest, a rocking mechanism QC for rocking the backrest portion 5C and the seat portion 6C interlockingly, a backrest upper portion inclining mechanism RC for rearwardly inclining only an upper portion of the backrest portion 5C for a sitter to stretch his or her body or the like, and a backrest lower portion inclining mechanism SC utilized to press lumbar bones selectively or for other purposes.

Specifically, the base leg 2C comprises a shaft of rotation 21C extending upwardly from the center of a leg impeller 20C for turning the seat portion 6C and backrest portion 5C supported on the base leg 2C about the shaft of rotation 21C. The lifting mechanism PC comprises a gas spring 22C incorporated into the shaft of rotation 21C of the base leg 2C and is capable of locking the seat and backrest at any desired vertical position within an operable range of the seat and backrest if the gas spring 22C is operated appropriately.

The backrest portion 5C comprises a backrest lower frame 50C, a backrest upper frame 55C, and an upholstery member 8C spanning between these two frames 50C and 55C through an elastic member not shown, the two frames 50C and 55C being rotatably mounted on a shaft of rotation 72C extending between inner sides of a link element 7*b*C.

The seat portion 6C comprises a cushion body 60C having a depression corresponding to the thighs of a sitter, and a shell 61C supporting a lower portion of the cushion body 60C.

On the other hand, the rocking mechanism QC is mainly formed of a trapeziform link mechanism comprising a support base 3C mounted on the base leg 2C, a seat support 4C supporting the seat portion 6C, and link elements 7*a*C and 7*b*C interconnecting the support base 3C and the seat support 4C, and a gas spring 31C in association with the link mechanism for fixing the link element 7*a*C at an appropriate position. Seat ZC according to the present invention consists of the seat portion 6C and the seat support 4C.

The support base 3C is a V-shaped rigid member formed of diecast aluminum having a base end fixed to the shaft of rotation 21C and a tip end protruding obliquely upward. On the underside of a central portion of an oblique side of the support base 3C is provided a torsion bar 70C that is capable of accumulating or releasing torsional elastic force through a shaft of rotation not shown.

The seat support 4C is a metal member such as aluminum formed into a planar shape and is provided on right and left sides thereof with arm pole fitting portions 44C (see FIG. 23) to which arm poles 9C are fitted.

The link element 7*ac* is a plate-shaped member having one end rotatably attached to a front portion of the support base 3C through a shaft of rotation 30C and other end rotatably attached to the reverse side of a front portion of the seat support 4C through a support shaft 74C.

The link element 7*b*C has one end fixed to the shaft of rotation of the torsion bar 70C located at a central portion of the oblique side of the support base 3C and other end linked to a shaft of rotation 79C located on the rear end side of the seat support 4C. Usually, the backrest lower frame 50C and the backrest upper frame 55C are integrally fixed to the link element 7*b*C with their rotating functions about the shaft of rotation 72C being inhibited and are rotatable about the shaft of rotation of the torsion bar 70C together with the link element 7*b*C.

The gas spring 31C is located between the link element 7*a*C and the support base 3C and functions to selectively lock the link element 7*a*C thereby locking the entire trapeziform link mechanism.

The backrest upper portion inclining mechanism RC becomes capable of functioning when the backrest upper frame 55C is allowed to rotate about the shaft of rotation 72C. Specifically, the backrest upper portion inclining mechanism RC comprises a locking mechanism rC and a spring member 73C.

As shown in FIG. 19, the locking mechanism rC comprises a hole portion 77C located in an upper portion of the link element 7*b*C, a hole portion 551C defined at a bracket 550C that is rhombic in side view and is mounted on the backrest upper frame 55C, and a pin 76C that is usually located to extend through these hole portions 77C and is operable to release the binding between the backrest upper frame 55C and the link element 7*b*C when selectively drawn out of the hole portion 551C. On the inner side of the bracket 550C located on the inner side of a lower portion of the backrest upper frame 55C, there is provided a bracket 7*b*1C integral with the link 7*b*C, the bracket 7*b*1C being shaped identical with the bracket 550C. These brackets 550C and 7*b*1C are mated with each other so that the hole portion 77C is located on the inner side of the hole portion 551C to allow the pin 76C to be inserted therethrough. Thus, when the pin 76C is in the state inserted through these hole portions 77C and 551C, the link element 7*b*C and the backrest upper frame 55C are bound with each other to operate as one piece, while when the pin 76C is drawn out of the hole portion 551C, the binding is released and, hence, only the backrest upper frame 55C becomes independently rotatable about the shaft of rotation 72C.

The spring member 73C serves to impart resilience to the backrest upper frame 55C upon inclining and presses the backrest upper frame 55C toward its erected position.

Further, the backrest lower portion inclining mechanism SC utilizes the backrest lower frame 50C and comprises a gas spring not shown at such a position as to allow the gas spring to press the backrest lower frame 50C forwardly about the shaft of rotation 72C.

Figure 23:
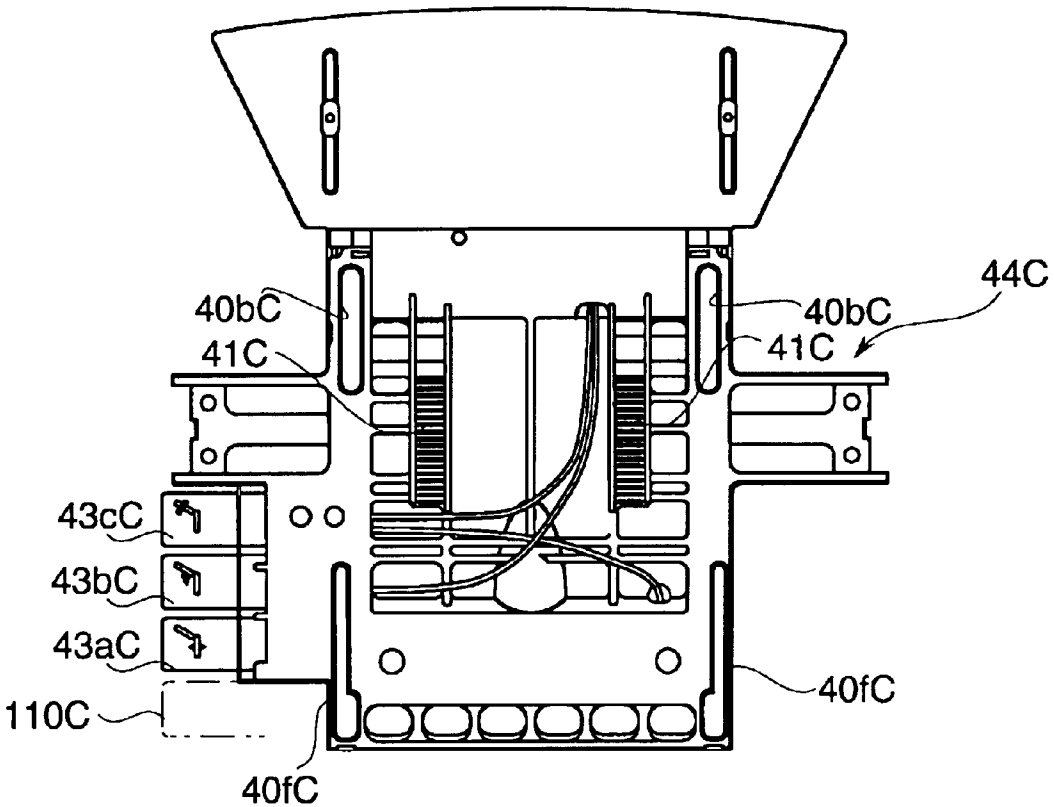
FIG. 23 is a plan view of the same embodiment with the seat portion cutaway.

The seat support 4C is provided with levers 43*a*C, 43*b*C and 43*c*C shown in FIG. 23 at a side end portion on the front side for selectively making use of the aforementioned mechanisms PC to SC under the condition that the seat portion 6C is mounted on the seat support 4C. The lever 43*a*C serves to lift up and down the seat portion 6C as shown in FIG. 20, the lever 43*b*C serves to rearwardly incline only the backrest lower frame 50C as shown in FIG. 22, and the lever 43*c*C serves to rock all of the seat portion 6C, backrest upper frame 55C and backrest lower frame 50C interlockingly as shown in FIG. 21. The inclining movement of only the backrest upper frame 55C is possible only when rocking is inhibited and can also be achieved without lever manipulation.

In this embodiment of the aforementioned construction, the seat portion 6C is mounted on the seat support 4C so as to be movable back and forth relative to the seat support 4C, while a fore-and-aft seat adjustment mechanism TC is provided for causing the seat portion 6C to move back and forth.

Figure 24:
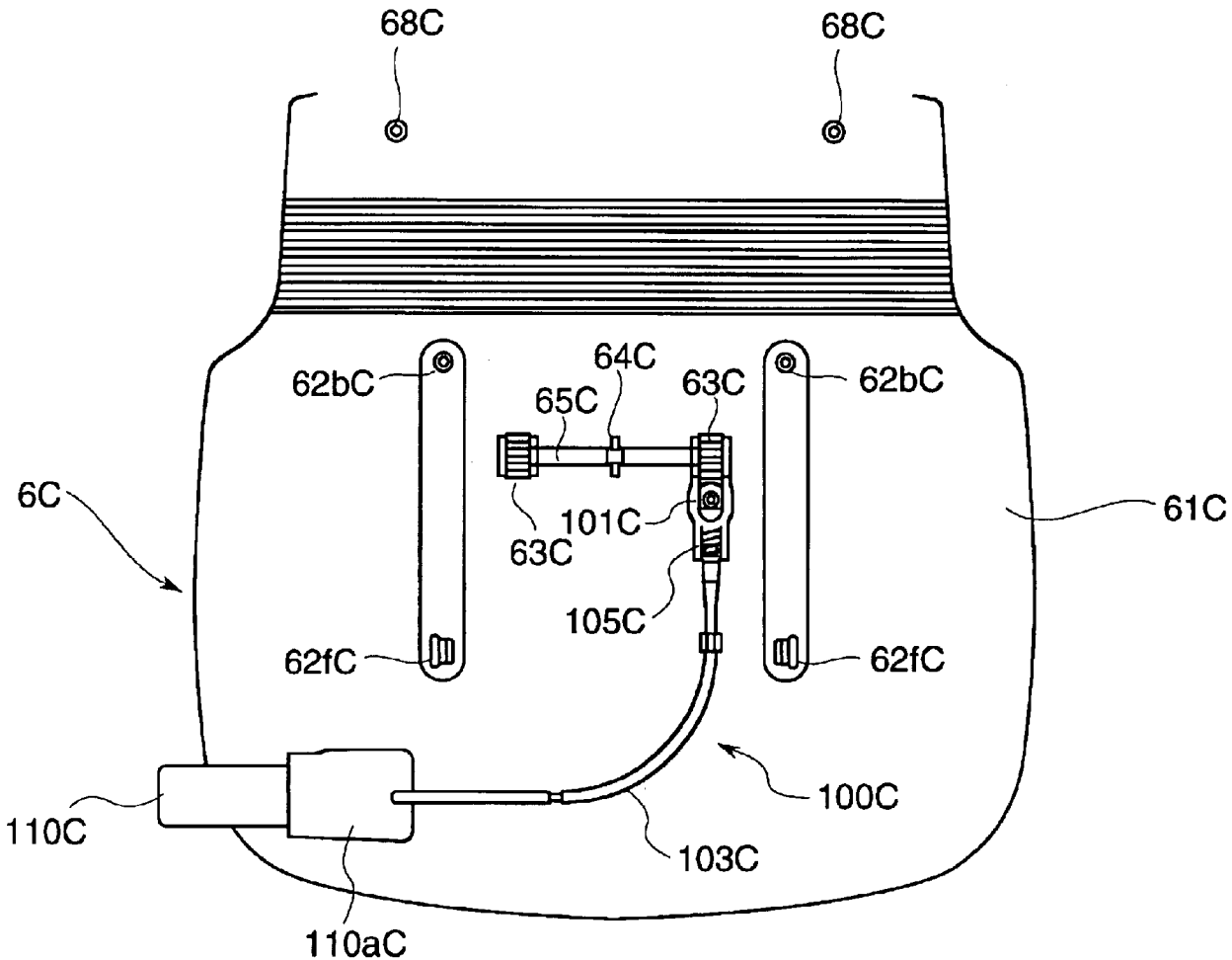
FIG. 24 is a bottom view showing the seat portion in the same embodiment.

The seat portion 6C comprises the cushion body 60C and the shell 61C as described above, and the shell 61C has a lower side provided with projections 62*f*C and 62*b*C on the front and rear end sides thereof for allowing the shell 61C to be removably fitted to the seat support 4C as shown in FIG. 24. On the other hand, the seat support 4C is formed with slots 40*f*C and 40*b*C extending in the fore-and-aft direction at locations on its flat portion corresponding to the projections 62*f*C and 62*b*C as shown in FIG. 23. The projections 62*f*C and 62*b*C of the shell 61C have appropriate come-off preventive structures at their inserting ends and are inserted into the slots 40*f*C and 40*b*C, so that the seat portion 6C is allowed to move back and forth relative to the seat support 4C while being inhibited to come off the seat support 4C upwardly.

The afore-and-aft seat moving mechanism TC comprises racks 41C mounted on the upper side of the seat support 4C, and pinions 63C mounted on the underside of the shell 61C forming part of the seat portion 6C, the pinions 63C meshing with the racks 41C to guide fore-and-aft sliding movement of the seat portion 6C relative to the seat support 4C. A pair of the racks 4C are positioned at locations laterally spaced apart from a widthwise central portion of the seat support 4C, while the pinions 63 are located on opposite ends of a shaft 65C held by a shaft holding portion 64C formed on the underside of the seat portion 6C. In brief, the fore-and-aft seat moving mechanism TC is adapted to move the seat portion 6C back and forth relative to the seat support 4C with the help of human's manipulating power applied thereto.

Figure 25:
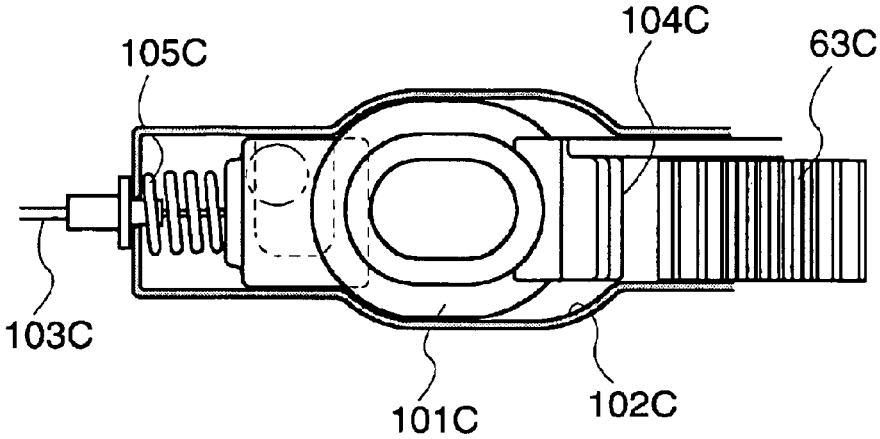
FIG. 25 shows a locking mechanism as a relevant part in the same embodiment.
Figure 26:
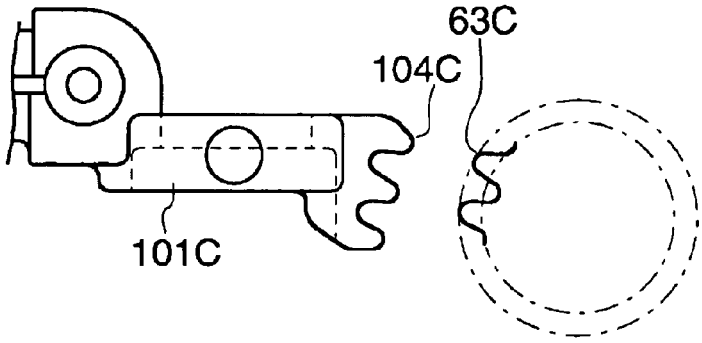
FIG. 26 is a side view of the locking mechanism in FIG. 25.

This chair is further provided with a locking mechanism 100C shown in FIGS. 24 to 26 for locking the seat portion 6C at a desired position in the fore-and-aft direction selectively, and a lever 110C serving as a manipulating section for operating the locking mechanism 100C, the lever 110C being disposed at such a position as to allow the lever 110C to move back and forth together with the seat portion 6C as one piece as shown in FIG. 24.

The locking mechanism 100C comprises a stopper piece 101C capable of meshing with the pinion 63C selectively through its movement toward and away from the pinion 63C. The stopper piece 101C is slidably fitted in a guide groove 102C defined at the underside of the seat portion 6C and is connected at its based end to one end of a wire tube 103C. Through a wire operation the stopper piece 101C is capable of causing teeth 104C formed at the tip thereof to selectively mesh with the pinion 63C by horizontally moving toward and away from the pinion 63C. The stopper piece 101C is elastically pressed in such a direction as to bring the stopper piece 101C into mesh with the pinion 63C by means of a spring 105C located in the guide groove 102C.

On the other hand, the lever 110C is fitted to a lever holding portion 110*a*C located on the underside of a right-hand side end portion on the front end side of the seat portion 6C and is connected at that position to the other end of the wire tube 103C so as to be capable of operating the wire tube 103C. When in a condition not manipulated, the lever 110C as well as the levers 43*a*C, 43*b*C and 43*c*C assumes a horizontal posture, while when the seat portion 6C is at a position in the fore-and-aft direction to which it has slid rearwardly, the lever 110C and the levers 43*a*C, 43*b*C and 43*c*C are regularly arranged with a substantially constant pitch. Only when the lever 110C is manipulated, the stopper piece 101C is retracted against the spring 105C so as to disengage from the pinion 63C thereby allowing the seat portion 6C to move back and forth. When the lever 110C is moved forward away from the lever 43*a*C, the seat portion 6C can move forward to a position depicted by phantom line in FIG. 22.

As described above, the chair according to this embodiment is constructed such that the seat portion 6C is mounted on the seat support 4C so as to be capable of moving back and forth. The chair includes the locking mechanism 100C for locking the seat portion 6C at a desired position in the fore-and-aft direction selectively, and the lever 110C serving as the manipulating section for operating the locking mechanism 100C and located at such a position as to allow the lever 110C to move back and forth together with the seat portion 6C as one piece.

Accordingly, the lever 110C moves together with the seat portion 6C whenever the seat portion 6C moves back and forth and, hence, the position of the lever 110C relative to the seat portion 6C will not change. Thus, the chair allows the sitter to maintain his or her manipulating posture with his or her hand properly put on the seat portion 6C and with his or her fingers properly catching the lever 110C and, therefore, it is possible to make good operability and sitting posture stability compatible with each other advantageously.

Specifically, since the seat portion 6C is supported on the seat support 4C through the rack-and-pinion mechanism comprising the racks 41C located on the seat support 4C side and the pinions 63C located on the seat portion 6C side together with the locking mechanism 110C (sic) and the lever 110C, it is possible to ensure fore-and-aft movement as well as to cause the locking mechanism 110C (sic) to lock the rotation of the pinions 63C, hence, lock the pinions 63C relative to the racks 41*c* reliably with the seat portion 6*c* serving as a foothold. It is also possible to incorporate these parts into the seat portion 6C or the seat support 4C relatively easily.

Particularly, since only the stopper piece 101C capable of selectively meshing with the pinion 63C through its movement toward and away from the pinion 63C to lock the rotation of the pinions 63C is employed as the locking mechanism 110C (sic), it is possible to realize compact incorporation.

Further, since the toward and away movement of the stopper piece 101C is performed horizontally, there is no need to provide an operating space between the seat support 4C and the seat portion 6C in the thicknesswise direction and, hence, the space between the seat support 4C and the seat portion 6C can effectively be prevented from becoming bulky due to the provision of the locking mechanism 100C.

Among others, this embodiment is constructed to cause the seat portion 6C to move back and forth relative to the seat support 4C with the help of human's manipulating power applied thereto from the outside and, hence, the sitter is capable of assuming a posture for manipulating the lever

110C and operating the seat portion 6C to move back and forth at the same time very naturally.

Further, since the lever 110C for operating the locking mechanism 100C and the levers 43*a*C, 43*b*C and 43*c*C located on the seat support 4C side as the manipulating sections for the locking mechanism QC and the like are arranged regularly when the seat portion 6C is at a rearwardly moved position, it is possible to manipulate the lever 110C in association with the manipulation of each of the levers 43*a*C, 43*b*C and 43*c*C efficiently, whereby the ease of use and the appearance can be improved.

It should be noted that the specific construction of each part is not limited to the foregoing embodiments and hence can be modified variously without departing from the spirit of the present invention.

INDUSTRIAL APPLICABILITY

As has been described, the chair according to the present invention is capable of adjusting the depth of the seating surface on which a sitter can substantially puts his or her back according to the builds of individual sitters by causing the seat portion to slide back and forth through the slide mechanism of a simple arrangement. Further, since the restraining section is capable of switching the seat portion between the slidable condition and the unslidable condition, the seat portion on which the sitter is sitting is prevented from moving unexpectedly thereby maintaining the stability of the seat portion. Furthermore, since the rear end portion of the seat portion rises gradually along the rear seat support as the seat portion is moved backward, it is possible to keep favorable the appearance of the whole chair.

Further, the chair according to present invention is constructed such that the rear seat plate gradually rises as smoothly curved along the rear seat support when the seat portion is moved back and forth to any position by means of the moving mechanism, so that the rear end portion of the seat body also gradually rises as smoothly curved without forming wrinkles of projection-depression shape. Further, since the front end side of the seat body is held by the rigid seat plate, the sitter does not directly feel the hardness of the seat support at his or her thighs. Thus, the sitter can sit on the chair comfortably without feeling sense of incongruity at his or her buttocks and thighs.

Furthermore, the chair according to the present invention allows the sitter to adjust the fore-and-aft position of the seat portion effectively and, at the same time, to maintain his or her manipulating posture with his or her hand properly put on the seat portion and with his or her fingers properly catching the manipulating section adapted to operate the locking mechanism and, therefore, it is possible to make good operability and sitting posture stability compatible with each other advantageously.

What is claimed is:

1. A chair comprising a seat portion, a seat support supporting the seat portion, a rear seat support extending rearwardly upwardly relative to the seat support on a rear end side of the seat support, a slide mechanism including members disposed in association with the seat portion and the seat support, wherein the members mesh with each other to cause the seat portion to slide back and forth relative to the seat support in a manner to cause a rear end portion of the seat portion to rise gradually when the seat portion slides rearward while deforming to cause the rear end portion to curve; and a restraining section for releasably restraining the sliding movement of the seat portion caused by the slide mechanism.

2. The chair according to claim 1, wherein the slide mechanism comprises a rack gear and a pinion gear disposed in association with the seat portion and the seat support; wherein the rack gear and pinion gear mesh with each other.

3. The chair according to claim 2, wherein the rack gear is secured to the seat support with a longitudinal direction of the rack gear being in line with a fore-and-aft direction, while the pinion gear is supported by the seat portion so as to be capable of rotating forwardly and backwardly.

4. The chair according to claim 3, wherein the seat portion is fitted with a manipulating section for selectively switching the restraining section into a condition allowing the seat portion to move or into a condition restraining the seat portion.

5. The chair according to claim 4, wherein the restraining section is provided with a stopper gear that is capable of disengageably meshing with the pinion gear to restrain the pinion gear from rotating through an operation of the manipulating section.

6. The chair according to claim 5, wherein: the restraining section is provided with an elastic member elastically deformably pressing the stopper gear in a direction such as to bring the stopper gear into mesh with the pinion gear; and the restraint of rotation of the pinion gear is released when the manipulating section is manipulated against the elastic force of the elastic member.

7. The chair according to claim 2, wherein the rack gear is secured to the seat portion with a longitudinal direction of the rack gear being in line with a fore-and-aft direction, while the pinion gear is supported by the seat support so as to be capable of rotating forwardly and backwardly.

8. The chair according to claim 7, wherein the seat support is fitted with a manipulating section for selectively switching the restraining section into a condition allowing the seat portion to move or into a condition restraining the seat portion.

9. The chair according to claim 8, wherein the restraining section comprises a dent portion formed at the seat support, and a stopper pin capable of retractably fitting into the dent portion to restrain the pinion gear from rotating through an operation of the manipulating section.

10. The chair according to claim 9, wherein: the restraining section is provided with an elastic member elastically deformably pressing the stopper pin in a direction such as to allow the stopper pin to become fitted into the dent portion; and the restraint of rotation of the pinion gear is released when the manipulating section is manipulated against the elastic force of the elastic member.

11. The chair according to claim 1, wherein a movable range restricting section for restricting the sliding movement of the seat portion within a predetermined range is formed in association with the seat portion and the seat support.

12. A chair comprising a seat portion having a seat body with a cushioning property, a seat support supporting at least a front end side of the seat portion, a rear seat support extending rearwardly upwardly relative to the seat support on a rear end side of the seat support, and a moving mechanism for sliding the whole of the seat portion back and forth along the seat support, wherein a rear end side of the seat portion rises gradually along the rear seat support when the seat portion slides backward, the seat body having a reverse side held by a rigid seat plate mounted to cover at least an extent from a front end side to a central portion of the reverse side and a flexibly deformable rear seat plate mounted at a rear end side of the reverse side, the rear seat plate being capable of smoothly curving to allow a rear end portion of the seat body to gradually rise along the rear seat support through the rear seat plate.

13. The chair according to claim 12, wherein the rear seat plate is formed with a plurality of groove portions arranged parallel in a fore-and-aft direction and each extending in a direction substantially perpendicularly intersecting the moving direction of the seat portion.

14. The chair according to claim 13, wherein the rear seat plate is carved so as to dent partially thereby forming the groove portions.

15. The chair according to claim 12, wherein a lift-off inhibiting section is formed in association with the rear seat plate, the seat support and the rear seat support for inhibiting the rear seat plate to lift off the seat support and the rear seat support during the back and forth movement of the seat portion.

16. The chair according to claim 15, wherein the lift-off inhibiting section comprises a slot defined at the rear seat plate to extend in a fore-and-aft direction, and pins attached to the seat support and the rear seat support, respectively, each of the pins having a head portion sized larger than the width of opening of the slot and a shank portion inserted through the slot.

17. A chair comprising a seat portion mounted on a seat support so as to be capable of moving in a fore-and-aft direction relative to the seat support by means of a moving mechanism, the moving mechanism including elements which are capable of moving only in the fore-and-aft direction relative to one another, the chair being provided with a locking mechanism for selectively locking the moving mechanism in a condition that the seat portion is located at a desired position in the fore-and-aft direction selectively, and a manipulating section for operating the locking mechanism, the manipulating section being directly manipulated by a user and located at a position allowing the manipulating section to move together with the seat portion in the fore-and-aft direction, wherein the locking and releasing of the seat portion relative to the seat support is caused by a manipulating force input to the manipulating section.

18. The chair according to claim 17, wherein the elements of the moving mechanism are a rack and a pinion, wherein the seat portion is supported on the seat support through the moving mechanism, wherein the rack is located on a seat support side and the pinion is located on a seat portion side together with the locking mechanism and the manipulating section.

19. The chair according to claim 18, wherein the locking mechanism comprises a stopper piece for locking the pinion by selectively meshing with the same through movement toward and away from the pinion.

20. The chair according to claim 19, wherein the stopper piece is configured to move horizontally toward and away from the pinion.

21. A chair comprising a seat portion mounted on a seat support so as to be capable of moving in a fore-and-aft direction, the chair being provided with a locking mechanism for locking the seat portion at a desired position in the fore-and-aft direction selectively, and a manipulating section for operating the locking mechanism, the manipulating section being directly manipulated by a user and located at a position allowing the manipulating section to move together with the seat portion in the fore-and-aft direction, wherein locking and releasing of the seat portion relative to the seat support is caused by a manipulating force input to the manipulating section, wherein the first manipulating section for operating the locking mechanism and other manipulating sections located on a seat support side for operating other mechanisms are arranged side-by-side in the fore-and-aft direction, wherein each of the first and other manipulating sections is a flat plate-shaped lever and assumes a substantially horizontal posture when it is not manipulated.

22. A chair comprising a seat portion, a seat support supporting the seat portion, a rear seat support extending rearwardly upwardly relative to the seat support on a rear end side of the seat support, a slide mechanism including members disposed in association with the seat portion and the seat support, wherein the members mesh with each other to cause the seat portion to slide back and forth relative to the seat support in a manner to cause a rear end portion of the seat portion to rise gradually when the seat portion slides rearward while deforming to cause the rear end portion to curve; and a restraining section for releasably restraining the sliding movement of the seat portion caused by the slide mechanism; wherein the slide mechanism comprises a rack gear and a pinion gear disposed in association with the seat portion and the seat support; wherein the rack gear and pinion gear mesh with each other.

23. A chair comprising a seat portion mounted on a seat support so as to be capable of moving in a fore-and-aft direction relative to the seat support by means of a moving mechanism, the moving mechanism including elements which are capable of moving only in the fore-and-aft direction relative to one another, the chair being provided with a locking mechanism for selectively locking the moving mechanism in a condition that the seat portion is located at a desired position in the fore-and-aft direction selectively, and a manipulating section for operating the locking mechanism, the manipulating section being directly manipulated by a user and located at a position allowing the manipulating section to move together with the seat portion in the fore-and-aft direction, wherein the locking and releasing of the seat portion relative to the seat support is caused by a manipulating force input to the manipulating section; wherein the elements of the moving mechanism are a rack and a pinion, wherein the seat portion is supported on the seat support through the moving mechanism, wherein the rack is located on a seat support side and the pinion is located on a seat portion side together with the locking mechanism and the manipulating section.

* * * * *

UNITED STATES PATENT AND TRADEMARK OFFICE

CERTIFICATE OF CORRECTION

PATENT NO. : 6,945,605 B2
DATED : September 20, 2005
INVENTOR(S) : Yojiro Kinoshita et al.

It is certified that error appears in the above-identified patent and that said Letters Patent is hereby corrected as shown below:

Column 23,
Line 53, replace "portion, a" with -- portion, the seat portion moveable up and down; a --.
Line 54, replace "portion," with -- portion; -- and replace "support extending" with -- support fixed to a rear end side of the seat support and extending --.
Lines 55-56, replace "support on a rear end side of the seat support," with -- support; --.
Line 59, replace "relative to" with -- along --.
Line 60, replace "support in" with -- support independently of up and down movement of the seat portion, in --.
Line 61, replace "gradually when the" with -- gradually with the rear end portion of the seat portion being guided by the rear seat support wherein the --.

Column 25,
Line 20, replace "portion mounted" with -- portion movable up and down and mounted --.
Line 21, replace "to be capable of moving in" with -- to move in --.
Line 22, replace "support by" with -- support independently of up and down movement of the seat portion, by --.
Line 58, replace "a manipulating" with -- a first manipulating --.

Column 26,
Lines 1-2, 3 and 9, replace "the manipulating" with -- the first manipulating --.

Signed and Sealed this

Twenty-fifth Day of April, 2006

JON W. DUDAS
*Director of the United States Patent and Trademark Office*